US011064288B2

(12) United States Patent
Ikeuchi et al.

(10) Patent No.: US 11,064,288 B2
(45) Date of Patent: Jul. 13, 2021

(54) HORN FOR SPEAKERS AND HORN SPEAKER

(71) Applicant: Panasonic Intellectual Property Management Co., Ltd., Osaka (JP)

(72) Inventors: Kazuhiko Ikeuchi, Osaka (JP); Kazuya Asahina, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/609,155

(22) PCT Filed: Sep. 6, 2018

(86) PCT No.: PCT/JP2018/033083
§ 371 (c)(1),
(2) Date: Oct. 28, 2019

(87) PCT Pub. No.: WO2019/092966
PCT Pub. Date: May 16, 2019

(65) Prior Publication Data

US 2020/0413185 A1 Dec. 31, 2020

(30) Foreign Application Priority Data

Nov. 13, 2017 (JP) ..... JP2017-218088

(51) Int. Cl.
*H04R 1/30* (2006.01)
*H04R 1/28* (2006.01)

(52) U.S. Cl.
CPC ..... *H04R 1/2865* (2013.01)

(58) Field of Classification Search
CPC ..... H04R 1/30; H04R 1/02; Y10T 29/4957; Y10T 29/49575; G10K 11/025
(Continued)

(56) References Cited

U.S. PATENT DOCUMENTS 4,071,112 A * 1/1978 Keele, Jr. ..... G10K 11/28 181/159
4,158,400 A 6/1979 Vice
(Continued)

FOREIGN PATENT DOCUMENTS

JP S55-690 A 1/1980
JP S62-78996 A 4/1987
(Continued)

OTHER PUBLICATIONS

International Search Report issued in corresponding International Patent Application No. PCT/JP2018/033083, dated Dec. 4, 2018, with English translation.
(Continued)

*Primary Examiner* — George C Monikang
(74) *Attorney, Agent, or Firm* — McDermott Will & Emery LLP

(57) ABSTRACT

A horn for speakers includes a horn body including: a first opening located in a first end portion and having a circular shape; a second opening located in a second end portion and having a shape different from the circular shape; and a sound path connecting the first opening and the second opening. In a cross section including a central axis of the horn body, an inner surface of the sound path flares out in a quartic curve from the first opening toward the second opening. A length (L2) from the first end portion to the second end portion of the horn body is at least 0.8 times as large as a radius (R) of the first opening.

4 Claims, 46 Drawing Sheets

(58) Field of Classification Search
USPC ..... 381/340, 342, 87, 333–336
See application file for complete search history.

(56) References Cited

U.S. PATENT DOCUMENTS

| | | | | |
|---|---|---|---|---|
| 4,308,932 | A | 1/1982 | Keele, Jr. | |
| 2010/0032233 | A1* | 2/2010 | Moore | G10K 11/025 181/152 |

FOREIGN PATENT DOCUMENTS

| | | | |
|---|---|---|---|
| JP | H2-199993 | A | 8/1990 |
| JP | H8-228394 | A | 9/1996 |
| JP | 2010-136248 | A | 6/2010 |

OTHER PUBLICATIONS

Extended European Search Report issued in corresponding European Patent Application No. 18876146.4, dated Oct. 16, 2020.

* cited by examiner

EXAMPLE 2

COMPARATIVE EXAMPLE 1
(CONVENTIONAL TECHNIQUE EXAMPLE 1)

COMPARATIVE EXAMPLE 2
(CONVENTIONAL TECHNIQUE EXAMPLE 2)

COMPARATIVE EXAMPLE 3
(CONVENTIONAL TECHNIQUE EXAMPLE 3)

COMPARATIVE EXAMPLE 1

COMPARATIVE EXAMPLE 2

COMPARATIVE EXAMPLE 3

EXAMPLE 1

EXAMPLE 2 (EXAMPLE 5)

COMPARATIVE EXAMPLE 4

COMPARATIVE EXAMPLE 5

EXAMPLE 3

EXAMPLE 4

EXAMPLE 6

EXAMPLE 7

COMPARATIVE EXAMPLE 6
(CONVENTIONAL TECHNIQUE EXAMPLE 6)

COMPARATIVE EXAMPLE 6

EXAMPLE 7

COMPARATIVEEXAMPLE7 (QUARTIC CURVE, 5mm)

COMPARATIVEEXAMPLE8 (QUADRATIC CURVE, 5mm)

COMPARATIVEEXAMPLE9 (QUARTIC CURVE,10mm)

COMPARATIVEEXAMPLE10 (QUADRATIC CURVE, 10 mm)

EXAMPLE 8 QUARTIC CURVE, 15mm)

COMPARATIVEEXAMPLE11 (QUADRATIC CURVE, 15mm)

EXAMPLE 9 (QUARTIC CURVE, 25mm)

COMPARATIVE EXAMPLE12CONICAL SHAPE, 25mm)

FIG. 27

| | | |
|---|---|---|
| EXPERIMENT 1 | EXAMPLE 1 | SPEAKER AND HORN FOR SPEAKERS (SOUND PATH:QUARTIC CURVE,CORNER:RIGHT-ANGLED SHAPE) |
| | EXAMPLE 2 | SPEAKER AND HORN FOR SPEAKERS (SOUND PATH:QUARTIC CURVE,CORNER:RADIUSED SHAPE) |
| | COMPARATIVE EXAMPLE 1 (CONVENTIONAL TECHNIQUE EXAMPLE 1) | ONLY SPEAKER |
| | COMPARATIVE EXAMPLE 2 (CONVENTIONAL TECHNIQUE EXAMPLE 2) | SPEAKER AND HORN FOR SPEAKERS (SOUND PATH:CONICAL SHAPE,CORNER:RIGHT-ANGLED SHAPE) |
| | COMPARATIVE EXAMPLE 3 (CONVENTIONAL TECHNIQUE EXAMPLE 3) | SPEAKER AND HORN FOR SPEAKERS (SOUND PATH:CONICAL SHAPE,CORNER:RADIUSED SHAPE) |
| EXPERIMENT 2 | EXAMPLE 3 | SPEAKER AND HORN FOR SPEAKERS (LENGTH OF HORN BODY:15mm) |
| | EXAMPLE 4 | SPEAKER AND HORN FOR SPEAKERS (LENGTH OF HORN BODY:20mm) |
| | EXAMPLE 5 | SPEAKER AND HORN FOR SPEAKERS (LENGTH OF HORN BODY:25mm) |
| | EXAMPLE 6 | SPEAKER AND HORN FOR SPEAKERS (LENGTH OF HORN BODY:30mm) |
| | COMPARATIVE EXAMPLE 4 | SPEAKER AND HORN FOR SPEAKERS (LENGTH OF HORN BODY:5mm) |
| | COMPARATIVE EXAMPLE 5 | SPEAKER AND HORN FOR SPEAKERS (LENGTH OF HORN BODY:10mm) |
| EXPERIMENT 3 | EXAMPLE 7 | ANOTHER SPEAKER AND HORN FOR SPEAKERS |
| | COMPARATIVE EXAMPLE 6 (CONVENTIONAL TECHNIQUE EXAMPLE 6) | ONLY ANOTHER SPEAKER |
| EXPERIMENT 4 | COMPARATIVE EXAMPLE 7 | SPEAKER AND HORN FOR SPEAKERS (SOUND PATH:QUARTIC CURVE,LENGTH OF HORN BODY:5mm) |
| | COMPARATIVE EXAMPLE 8 | SPEAKER AND HORN FOR SPEAKERS (SOUND PATH:QUADRATIC CURVE,LENGTH OF HORN BODY:5mm) |
| | COMPARATIVE EXAMPLE 9 | SPEAKER AND HORN FOR SPEAKERS (SOUND PATH:QUARTIC CURVE,LENGTH OF HORN BODY:10mm) |
| | COMPARATIVE EXAMPLE 10 | SPEAKER AND HORN FOR SPEAKERS (SOUND PATH:QUADRATIC CURVE,LENGTH OF HORN BODY:10mm) |
| | EXAMPLE 8 | SPEAKER AND HORN FOR SPEAKERS (SOUND PATH:QUARTIC CURVE,LENGTH OF HORN BODY:15mm) |
| | COMPARATIVE EXAMPLE 11 | SPEAKER AND HORN FOR SPEAKERS (SOUND PATH:QUADRATIC CURVE,LENGTH OF HORN BODY:15mm) |
| | EXAMPLE 9 | SPEAKER AND HORN FOR SPEAKERS (SOUND PATH:QUARTIC CURVE,LENGTH OF HORN BODY:25mm) |
| | COMPARATIVE EXAMPLE 12 | SPEAKER AND HORN FOR SPEAKERS (SOUND PATH:CONICAL SHAPE,LENGTH OF HORN BODY:25mm) |

HORN FOR SPEAKERS AND HORN SPEAKER

CROSS-REFERENCE OF RELATED APPLICATIONS

This application is the U.S. National Phase under 35 U.S.C. § 371 of International Patent Application No. PCT/JP2018/033083, filed on Sep. 6, 2018, which in turn claims the benefit of Japanese Application No. 2017-218088, filed on Nov. 13, 2017, the entire disclosures of which Applications are incorporated by reference herein.

TECHNICAL FIELD

The present disclosure relates to a horn for speakers and a horn speaker.

BACKGROUND ART

Horns for speakers that are attachable to speakers have been known. The horn for speakers of Patent Literature (PTL) 1 includes a horn having a slit opening, and a throat disposed in the slit opening. The throat has one end portion including a circular opening for placing a diaphragm of a speaker. The throat has another end portion including a quadrilateral opening located in the slit opening of the horn. The horn has a reflective curved surface with a parabolic section having the quadrilateral opening as a focal position.

CITATION LIST

Patent Literature

PTL 1: Japanese Unexamined Patent Application Publication No. 2010-136248

SUMMARY OF THE INVENTION

Technical Problem

The present disclosure provides a horn for speakers and a horn speaker that are capable of increasing directivity characteristics of the mid- to high-frequency ranges.

Solution to Problem

A horn for speakers in the present disclosure is a horn for speakers attachable to a speaker, and includes a horn body including: a first opening located in a first end portion and having a circular shape; a second opening located in a second end portion and having a shape different from the circular shape; and a sound path connecting the first opening and the second opening. In a cross section including a central axis of the horn body, an inner surface of the sound path flares out in a quartic curve from the first opening toward the second opening. A length from the first end portion to the second end portion of the horn body is at least 0.8 times as large as a radius of the first opening.

Advantageous Effect of Invention

A horn for speakers etc. according to the present disclosure can increase directivity characteristics of the mid- to high-frequency ranges.

BRIEF DESCRIPTION OF DRAWINGS

FIG. 27 is a table that lists experimental conditions for Experiments 1 to 4.

DESCRIPTION OF EXEMPLARY EMBODIMENT (Underlying Knowledge Forming Basis of the Present Invention)

The inventors have found that the following problem occurs with regard to the technique described in the forgoing "BACKGROUND ART" section.

The horn for speakers of PTL 1 has narrow directivity characteristics in a specific direction, but sound leaks from the horn in directions other than the specific direction. Reflection of the leaked sound from the inner wall surface etc. hurts the narrow directivity characteristics.

Hereinafter, an exemplary embodiment will be described in detail with reference to the drawings as necessary. However, unnecessarily detailed description may be omitted. For example, detailed description of well-known matter and overlapping description of identical elements may be omitted. This is to avoid unnecessary redundancy and provide easy-to-read description for a person skilled in the art.

It should be noted that the accompanying drawings and the subsequent description are provided by the inventors in order for a person skilled in the art to sufficiently understand the present disclosure, and are thus not intended to limit the subject matter recited in the claims.

Embodiment

Hereinafter, the embodiment will be described with reference to FIG. 1 through FIG. 27.

1. Configuration of Horn Speaker

Figure 1:
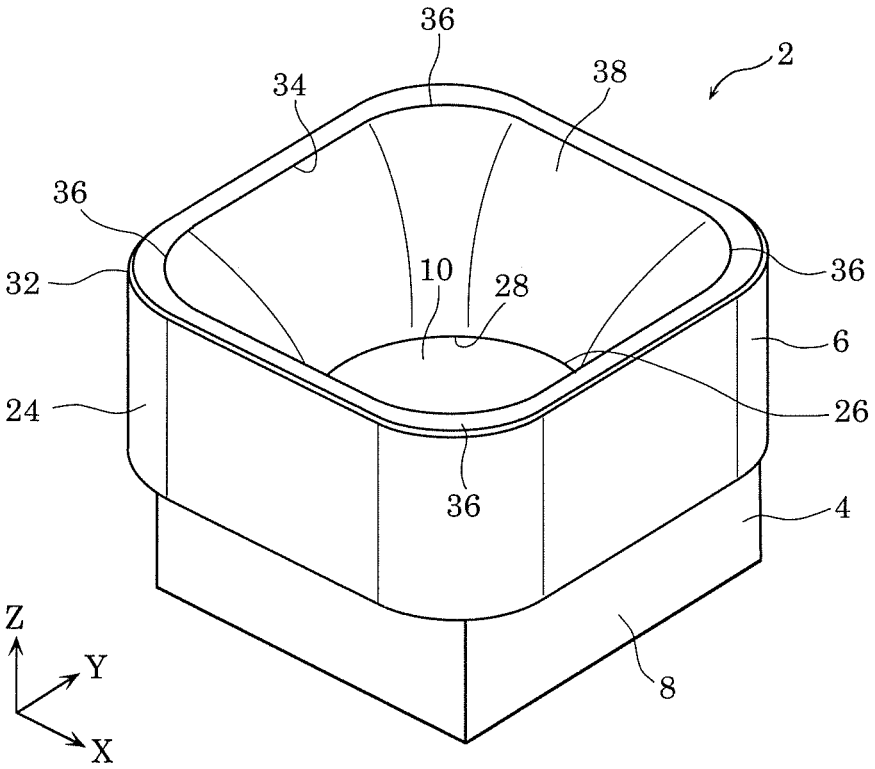
FIG. 1 is a perspective view of a horn speaker according to an embodiment.
Figure 2:
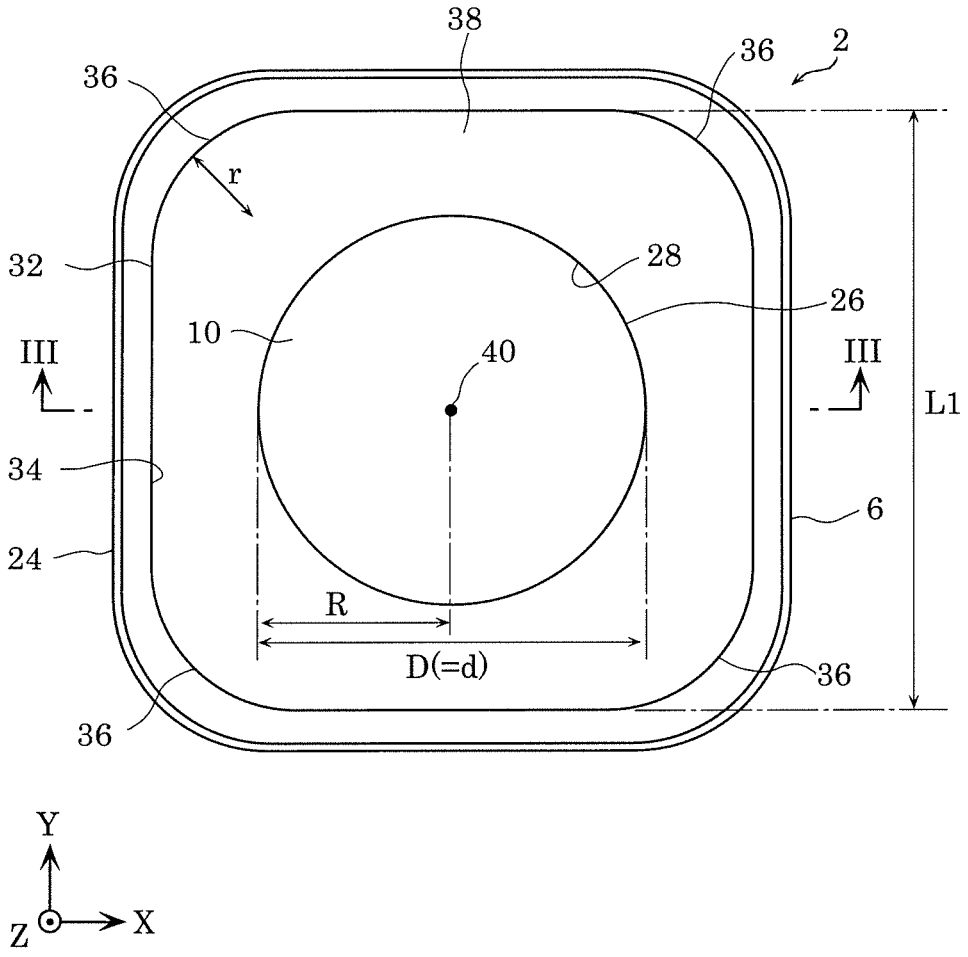
FIG. 2 is a plan view of the horn speaker according to the embodiment.
Figure 3:
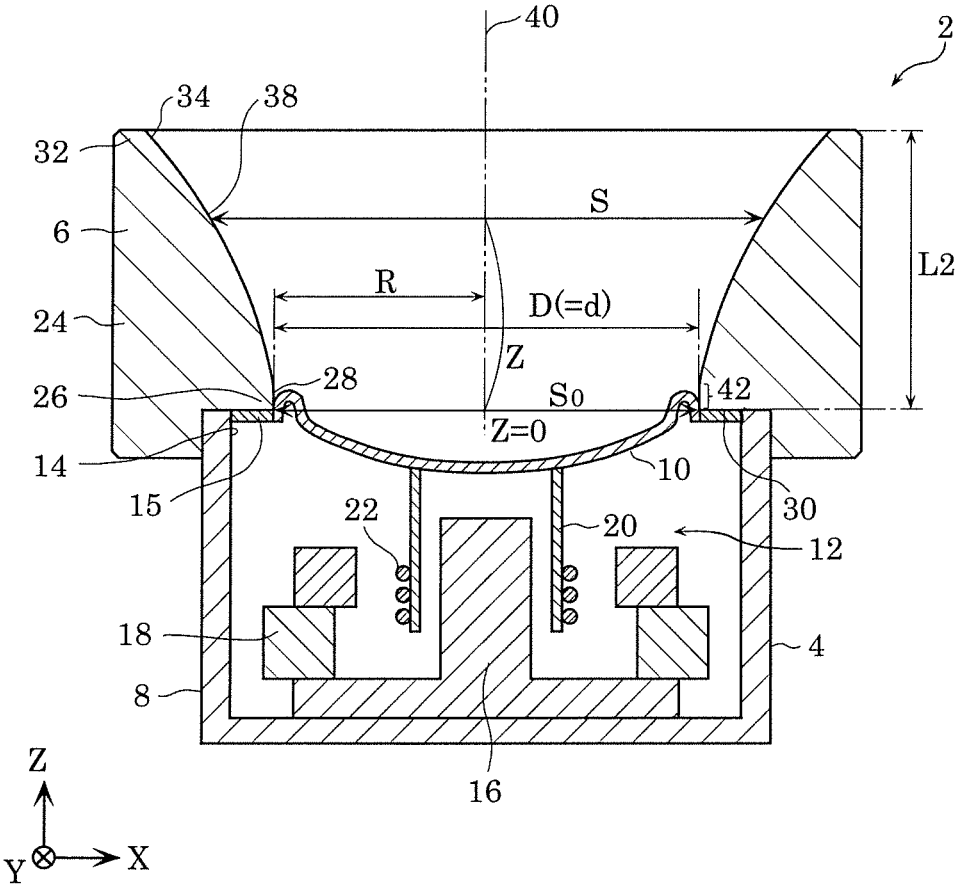
FIG. 3 is a cross-sectional view of the horn speaker according to the embodiment, taken along line in FIG. 2.
Figure 4:
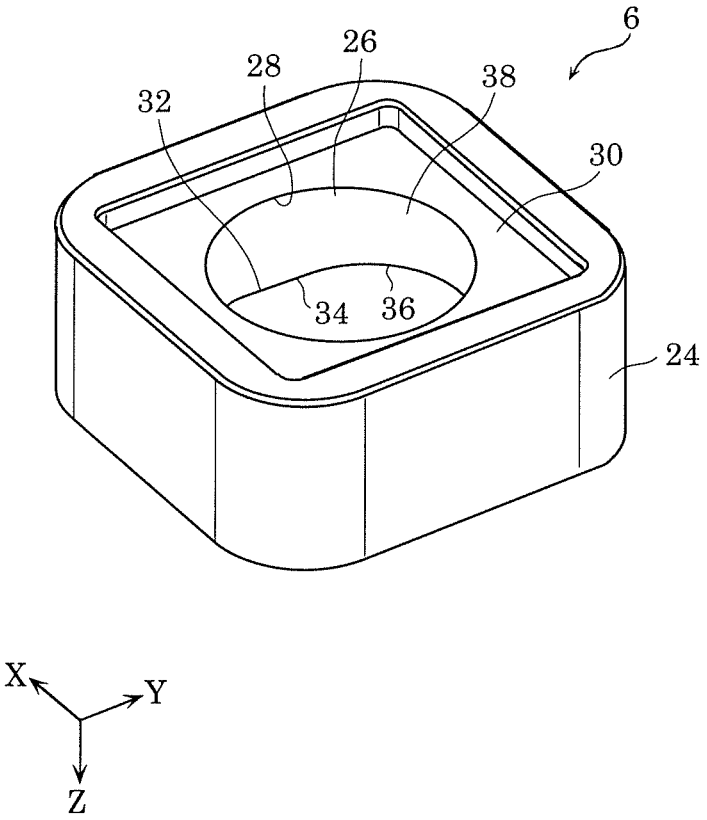
FIG. 4 is a perspective view of a horn for speakers according to the embodiment, as seen from a direction different from the direction in FIG. 1.

First, the configuration of horn speaker 2 according to the embodiment will be described with reference to FIG. 1 through FIG. 4. FIG. 1 is a perspective view of horn speaker 2 according to the embodiment. FIG. 2 is a plan view of horn speaker 2 according to the embodiment. FIG. 3 is a cross-sectional view of horn speaker 2 according to the embodiment, taken along line in FIG. 2. FIG. 4 is a perspective view of horn for speakers 6 according to the embodiment, as seen from a direction different from the direction in FIG. 1.

As shown in FIG. 1 to FIG. 3, horn speaker 2 according to the embodiment includes speaker 4 and horn for speakers 6.

As shown in FIG. 3, speaker 4 includes case 8, diaphragm 10, and driver 12. Case 8 is a hollow rectangular parallelpiped and has circular opening 14 in a side surface. As shown in FIG. 2 and FIG. 3, diaphragm 10 is circular and funnel-shaped in the XY plan view. The periphery of diaphragm 10 is supported by opening 14 of case 8 via ring-shaped edge 15. Diameter d of diaphragm 10 is 38 mm, for example.

Driver 12 is an actuator for vibrating diaphragm 10, and is disposed inside case 8. Driver 12 includes yoke 16, magnet 18, bobbin 20, and voice coil 22. Magnet 18 is attached to yoke 16. Bobbin 20 is cylindrical and attached to a back surface of diaphragm 10. Part of yoke 16 is disposed on the inner side of bobbin 20. Voice coil 20 is wound around the outer circumferential surface of bobbin 20.

As shown in FIG. 1 to FIG. 4, horn for speakers 6 is a sound tube for obtaining narrow directivity characteristics of sound outputted from speaker 4, and is attached to opening 14 of speaker 4. Horn for speakers 6 includes horn body 24 made of, for example, resin.

As shown in FIG. 3 and FIG. 4, first end portion 26 of horn body 24 includes first opening 28 having a circular shape. Diameter D of first opening 28 is approximately equal to diameter d of diaphragm 10 of speaker 4, and is 38 mm, for example. Diaphragm 10 of speaker 4 is tightly placed in first opening 28 of horn body 24. It should be noted that first end portion 26 of horn body 24 includes step portion 30 for opening 14 of speaker 4.

As shown in FIG. 1 to FIG. 3, second end portion 32 of horn body 24 includes second opening 34 having a shape different from a circular shape, such as an approximately square shape (an example of an approximately quadrilateral shape). Length L1 of one side of second opening 34 is 60 mm, for example. As shown in FIG. 2, each of four corners 36 of second opening 34 has a radiused (R) shape. Radius of curvature r of each of four corners 36 of second opening 34 is 0.8 times as large as radius R (=19 mm) of first opening 28, and is 15 mm, for example.

As shown in FIG. 1 to FIG. 4, horn body 24 further includes sound path 38 that connects first opening 28 and second opening 34. As shown in FIG. 3, in the cross section including central axis 40 of horn body 24, the inner surface of sound path 38 flares out in a quartic curve from first opening 28 toward second opening 34. Sound path 38 is rotationally symmetric about central axis 40. In a cross section orthogonal to central axis 40 of horn body 24, the shape of sound path 38 continuously changes from a circular shape to an approximately square shape from first opening 28 to second opening 34. It should be noted that central axis 40 is a straight line that is parallel to the Z axis and passes through the radial center of first opening 28 and the radial center of second opening 34.

As shown in FIG. 3, in the cross section orthogonal to central axis 40 of horn body 24, the area of sound path 38 increases in proportion to the fourth power of a distance from first opening 28 along central axis 40 (the Z axis direction). Specifically, the relational expression $S=S_0\times(1+a\times z^4)$ is satisfied, where $S_0$ is the area of first opening (z=0), S is the area of sound path 38 at position z away from first opening 28 along central axis 40, and a is a constant. Accordingly, as shown in FIG. 3, in the cross section including central axis 40 of horn body 24, straight portion 42 that is part of the above-described quartic curve and parallels central axis 40 is located in the vicinity of first opening 28 in the inner surface of sound path 38.

As shown in FIG. 3, length L2 of horn body 24 from first end portion 26 to second end portion 32 (i.e., from first opening 28 to second opening 34) is at least 0.8 times as large as radius R (=19 mm) of first opening 28. In the present embodiment, length L2 of horn body 24 is 1.3 times as large as radius R of first opening 28, and is 25 mm, for example. It should be noted that length L2 of horn body 24 is less than 26 times as large as radius R of first opening 28.

2. Example of Application of Horn Speaker

Figure 5:
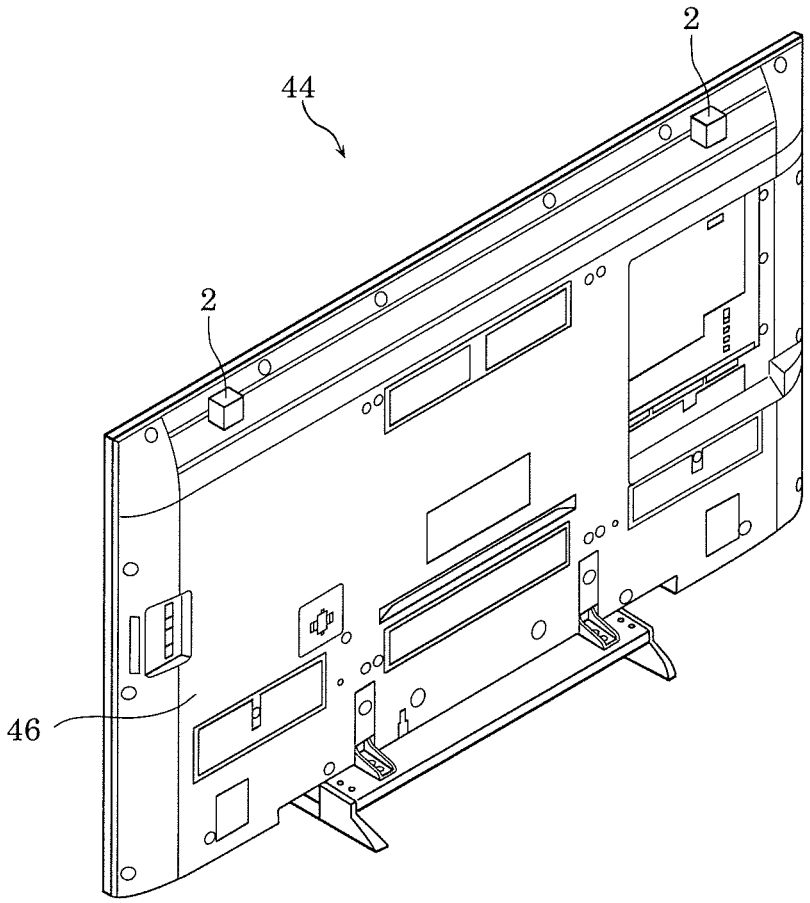
FIG. 5 is a perspective view of an example of application of the horn speaker according to the embodiment.

Next, an example of application of horn speaker 2 according to the embodiment will be described with reference to FIG. 5. FIG. 5 is a perspective view of horn speaker 2 according to the embodiment.

In the example shown in FIG. 5, horn speakers 2 are installed in image display apparatus 44 for displaying an image. Image display apparatus 44 is, for example, a television receiver. Horn speakers 2 are placed in an upper end portion of rear cabinet 46 covering a rear side (an opposite side of a display panel) of image display apparatus 44.

Second opening 34 of horn body 24 (see FIG. 1 to FIG. 4) of each horn speaker 2 is oriented in a direction for obtaining directivity characteristics (e.g., an obliquely upward direction on a front side of image display apparatus 44). It should be noted that for convenience of description, horn speakers 2 are illustrated simplistically in FIG. 5.

3. Advantageous Effects

As described above, horn for speakers 6 according to the embodiment is a horn for speakers attachable to speaker 4. Horn for speakers 6 includes horn body 24 including: first opening 28 located in first end portion 26 and having a circular shape; second opening 34 located in second end portion 32 and having a shape different from the circular shape; and sound path 38 connecting first opening 28 and second opening 34. In a cross section including central axis 40 of horn body 24, an inner surface of sound path 38 flares out in a quartic curve from first opening 28 toward second opening 34. Length L2 from first end portion 26 to second end portion 32 of horn body 24 is at least 0.8 times as large as radius R of first opening 28.

With this, by satisfying at least three conditions including a) making the shapes of first opening 28 and second opening 34 mutually different, b) forming the inner surface of sound path 38 in the quartic curve, and c) setting length L2 from first end portion 26 to second end portion 32 of horn body 24 to be at least 0.8 times as large as radius R of first opening 28, it is possible to further increase directivity characteristics of the mid- to high-frequency ranges of sound outputted from speaker 4. As a result, it is possible to obtain desired narrow directivity characteristics.

Moreover, in a cross section orthogonal to central axis 40 of horn body 24, a relational expression $S=S_0\times(1+a\times z^4)$ is satisfied, where $S_0$ is an area of first opening 28, S is an area of sound path 38 at position z away from first opening 28 along central axis 40, and a is a constant.

With this, straight portion 42 that is part of the above-described quartic curve and parallels central axis 40 is located in the vicinity of first opening 28 in the inner surface of sound path 38. As a result, it is possible to more effectively increase the directivity characteristics of the mid- to high-frequency ranges of the sound outputted from speaker 4.

Moreover, second opening 34 has an approximately quadrilateral shape, and each of four corners 36 of second opening 34 has a radiused shape.

With this, it is possible to further increase the directivity characteristics of the mid- to high-frequency ranges of the sound outputted from speaker 4.

Moreover, radius of curvature r of each of four corners 36 is 0.8 times as large as radius R of first opening 28.

With this, it is possible to further increase the directivity characteristics of the mid- to high-frequency ranges of the sound outputted from speaker 4.

Moreover, horn speaker 2 according to the embodiment includes: speaker 4 including diaphragm 10 having a circular shape in a plan view; and any one of above-described horns for speakers 6 attached to speaker 4. Diaphragm 10 is disposed in first opening 28 of horn for speakers 6.

With this, it is possible to increase directivity characteristics of the mid- to high-frequency ranges of sound outputted from speaker 4.

4. Examples and Comparative Examples

In order to determine an advantageous effect of the present embodiment, that is, an effect of increasing directivity characteristics of the mid- to high-frequency ranges of sound outputted from speaker 4, the following Experiments 1 to 4 were conducted. Hereinafter, Experiments 1 to 4 will be described with reference to FIG. 6A through FIG. 27. It should be noted that FIG. 27 is a table that lists experimental conditions for Experiments 1 to 4.

4-1. Experiment 1

First, Experiment 1 will be described with reference to FIG. 6A through FIG. 9C. Experiment 1 was conducted to evaluate how the presence or absence and shape of a horn for speakers affect directivity characteristics.

Figure 6A:
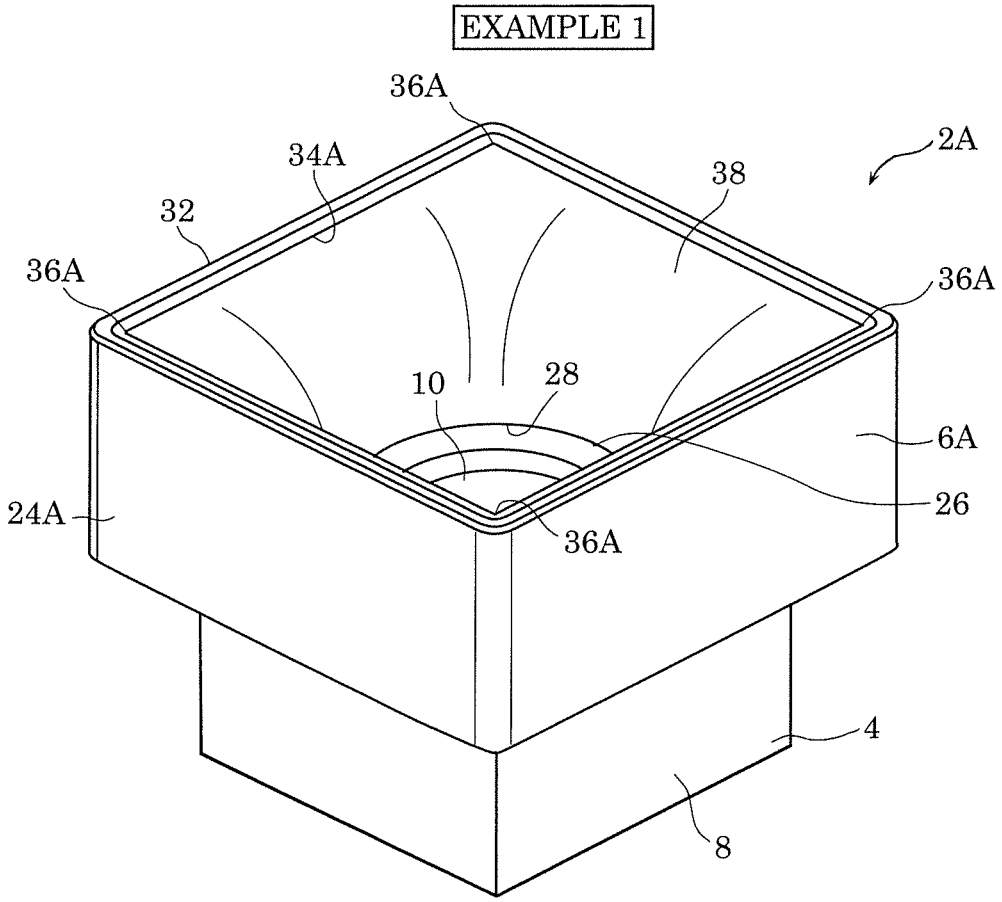
FIG. 6A is a perspective view of a horn speaker according to Example 1.
Figure 6B:
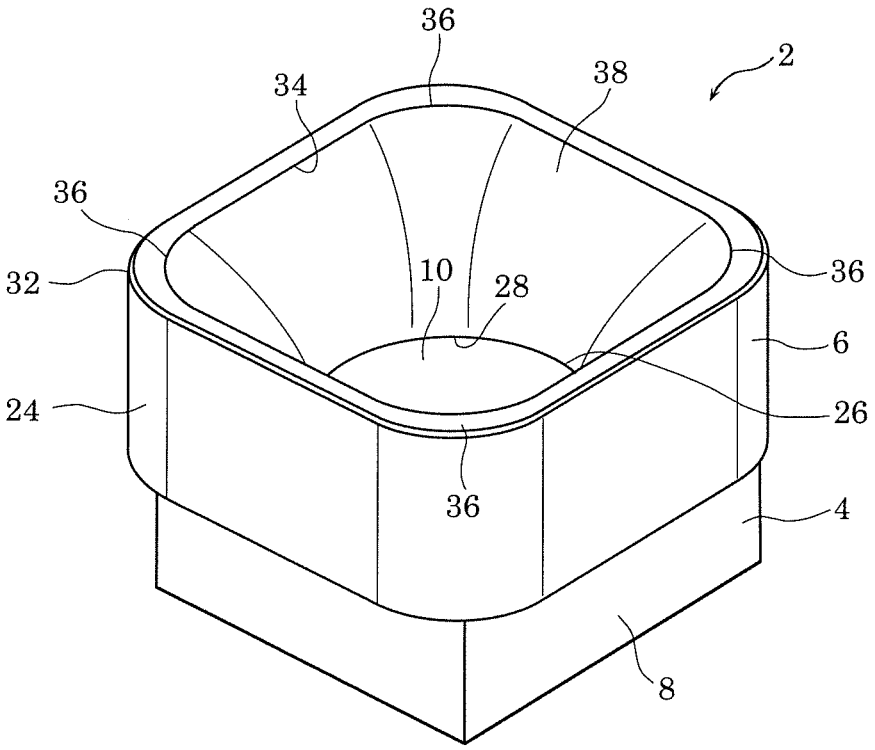
FIG. 6B is a perspective view of a horn speaker according to Example 2.
Figure 7A:
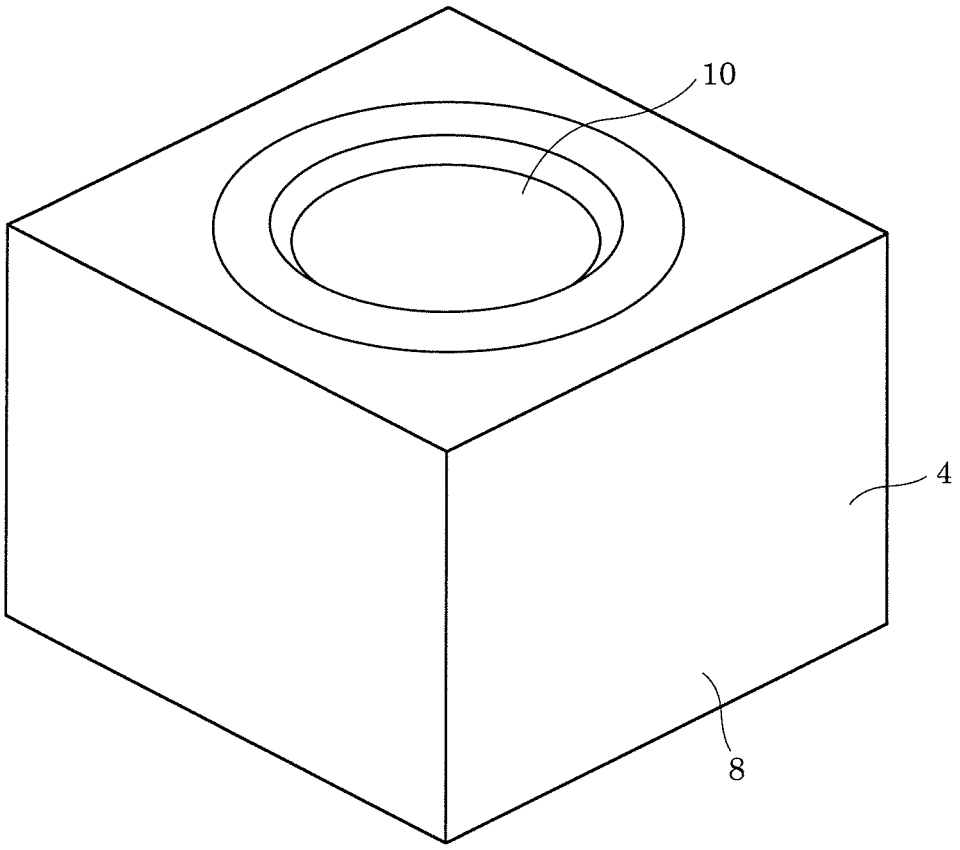
FIG. 7A is a perspective view of a speaker according to Comparative Example 1.
Figure 7B:
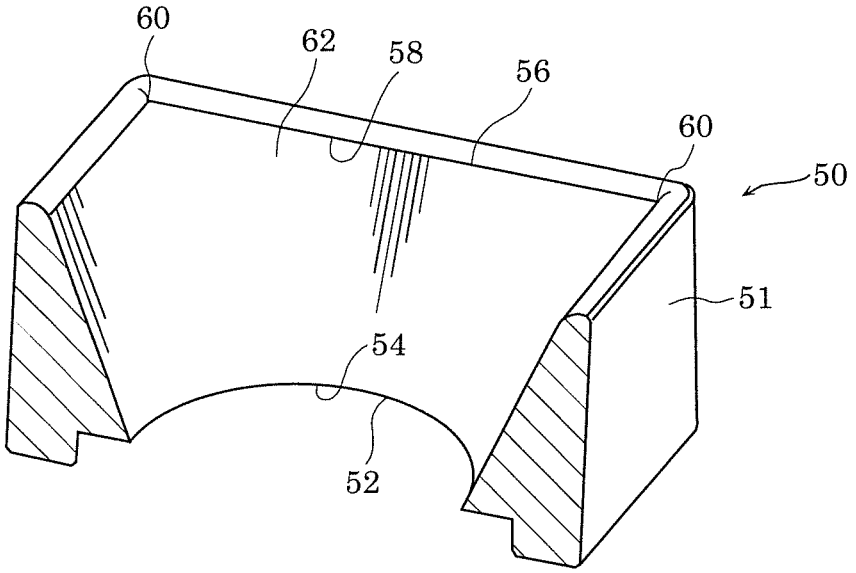
FIG. 7B is a cross-sectional perspective view of a horn for speakers according to Comparative Example 2.
Figure 7C:
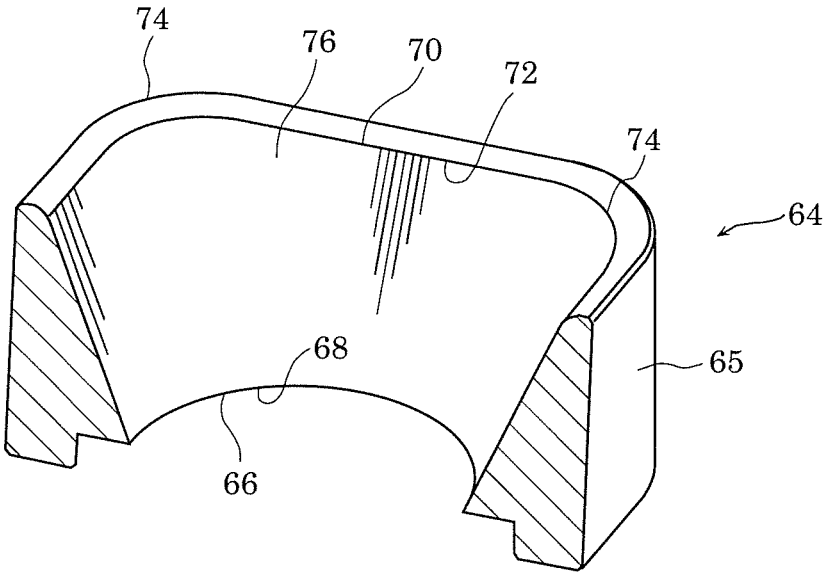
FIG. 7C is a cross-sectional perspective view of a horn for speakers according to Comparative Example 3.
Figure 8A:
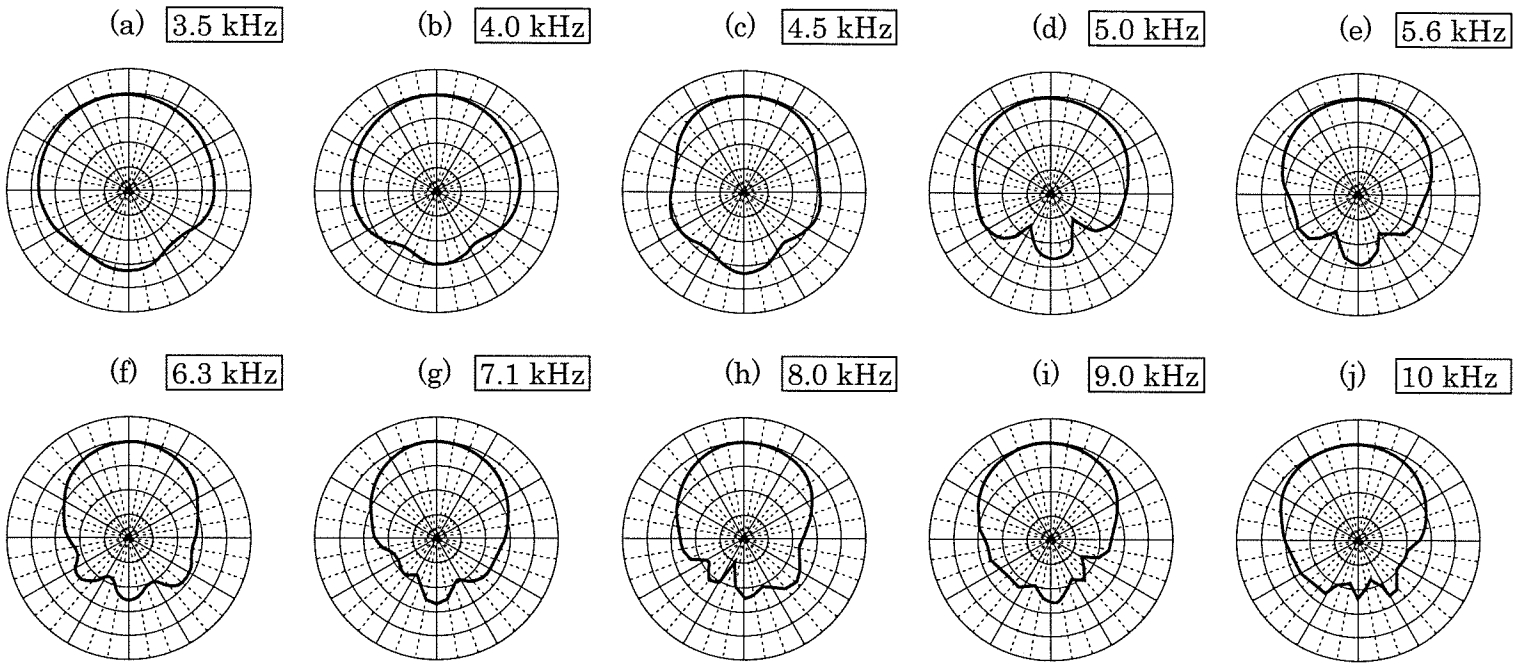
FIG. 8A shows polar patterns indicating directivity characteristics in Comparative Example 1.
Figure 8B:
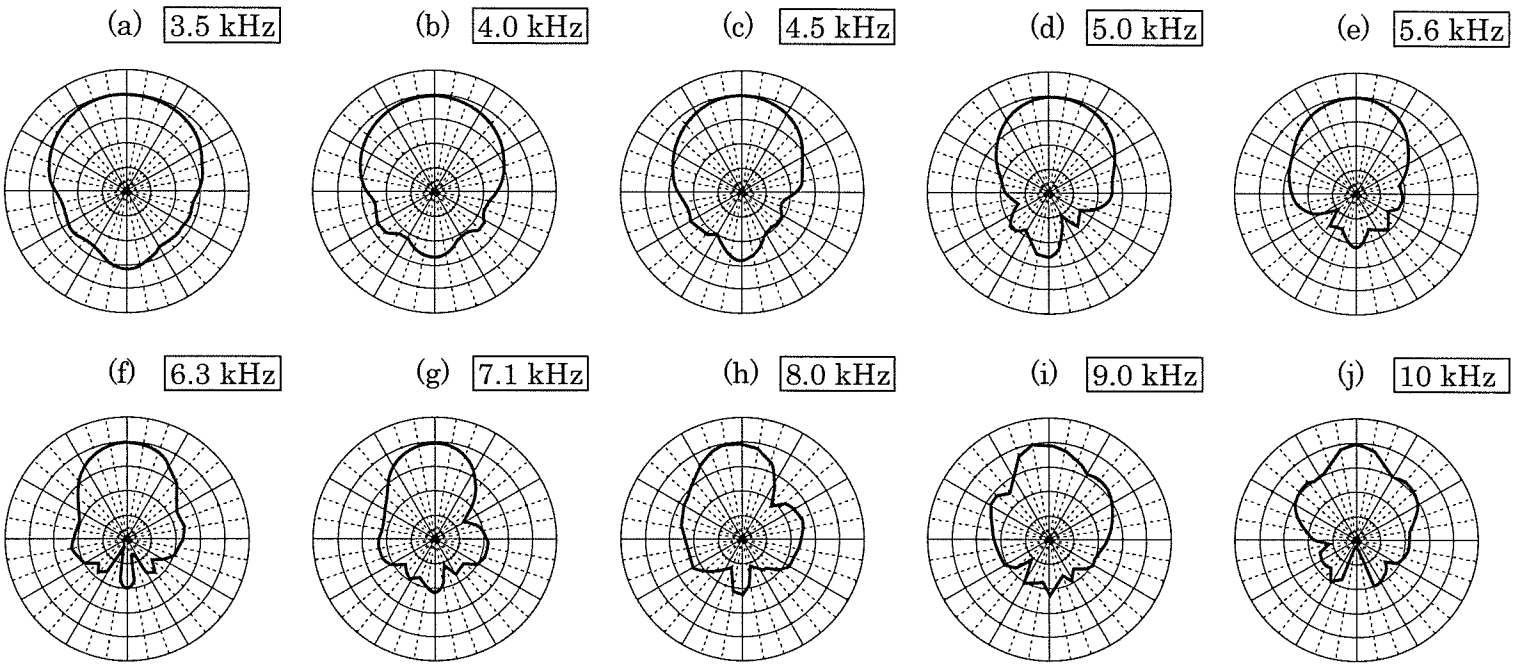
FIG. 8B shows polar patterns indicating directivity characteristics in Comparative Example 2.
Figure 8C:
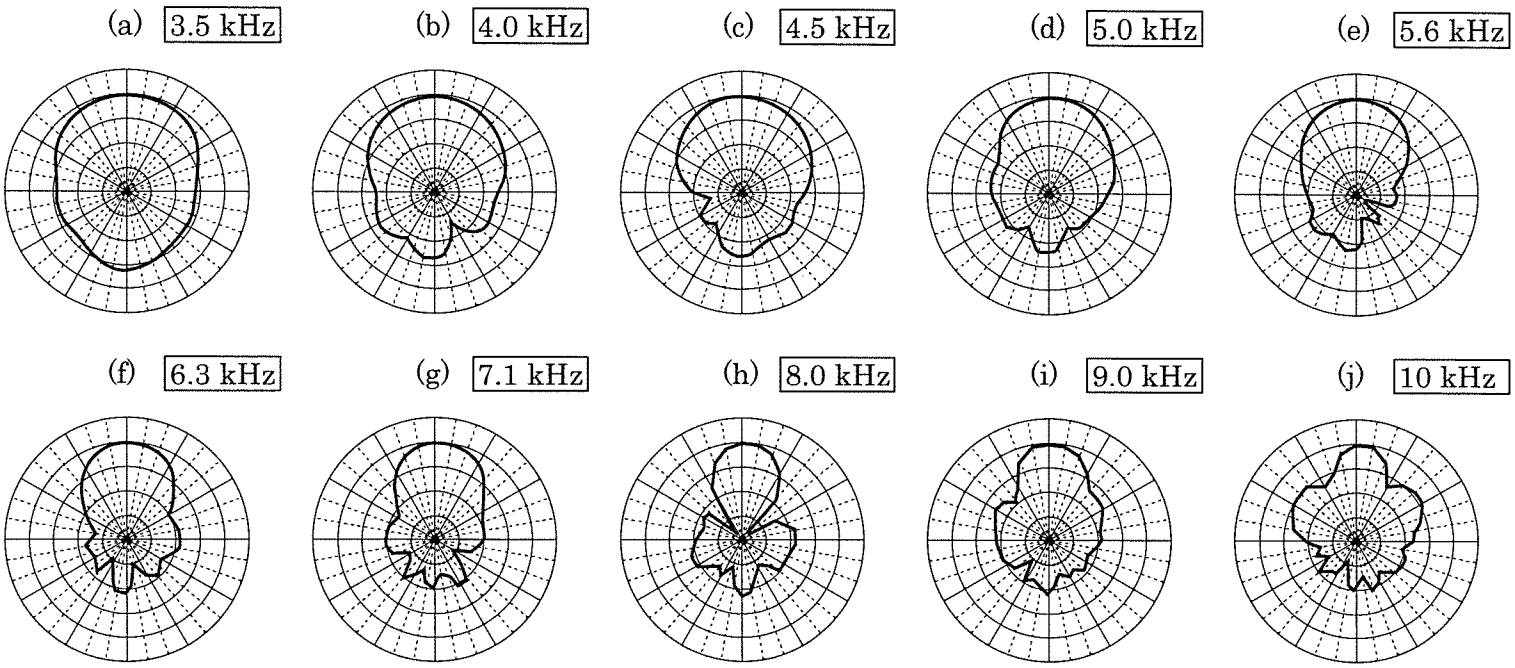
FIG. 8C shows polar patterns indicating directivity characteristics in Comparative Example 3.
Figure 8D:
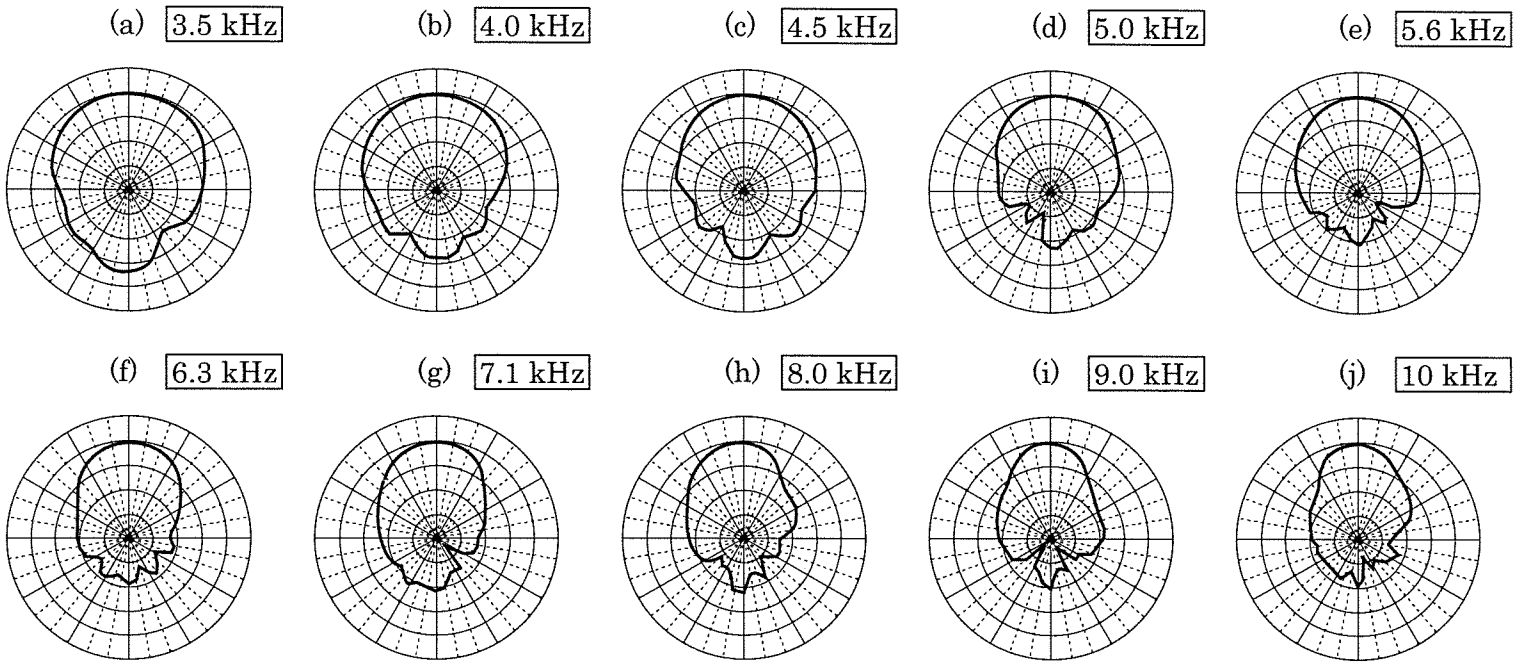
FIG. 8D shows polar patterns indicating directivity characteristics in Example 1.
Figure 8E:
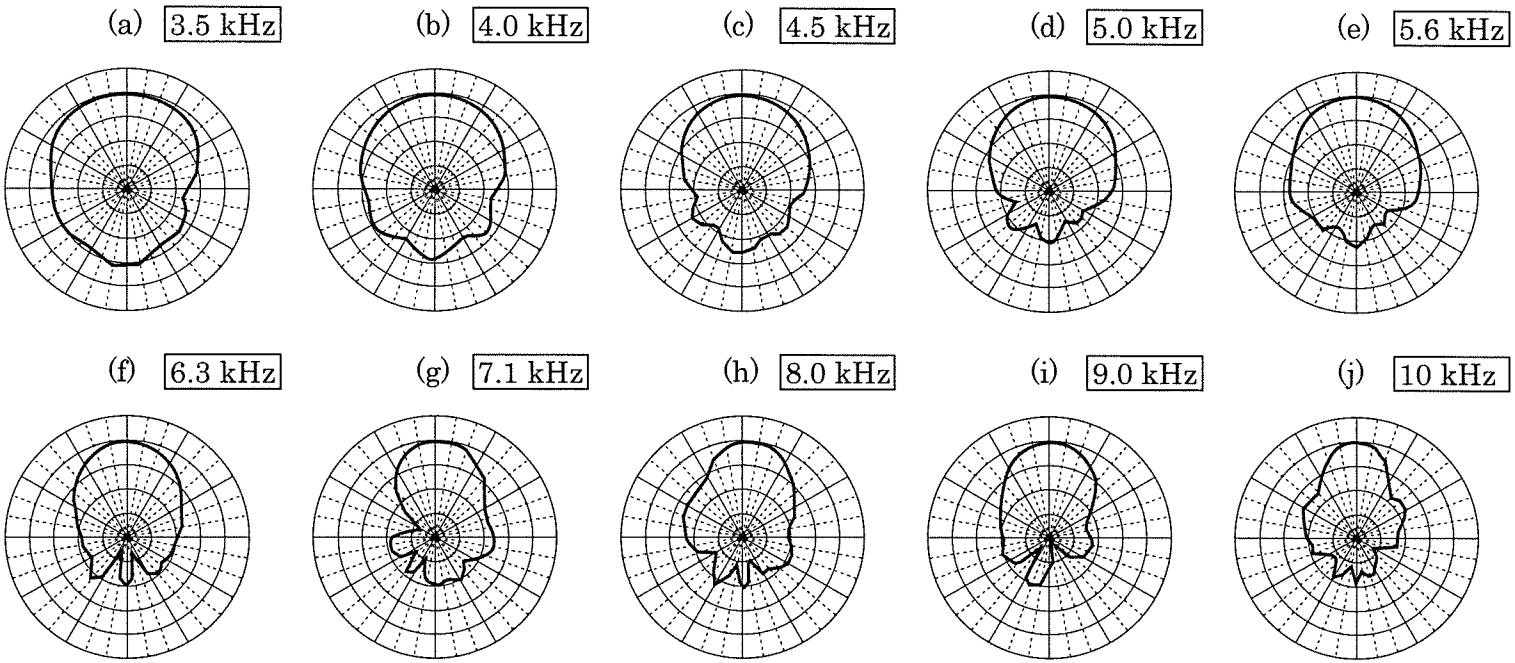
FIG. 8E shows polar patterns indicating directivity characteristics in Example 2 (Example 5).
Figure 9A:
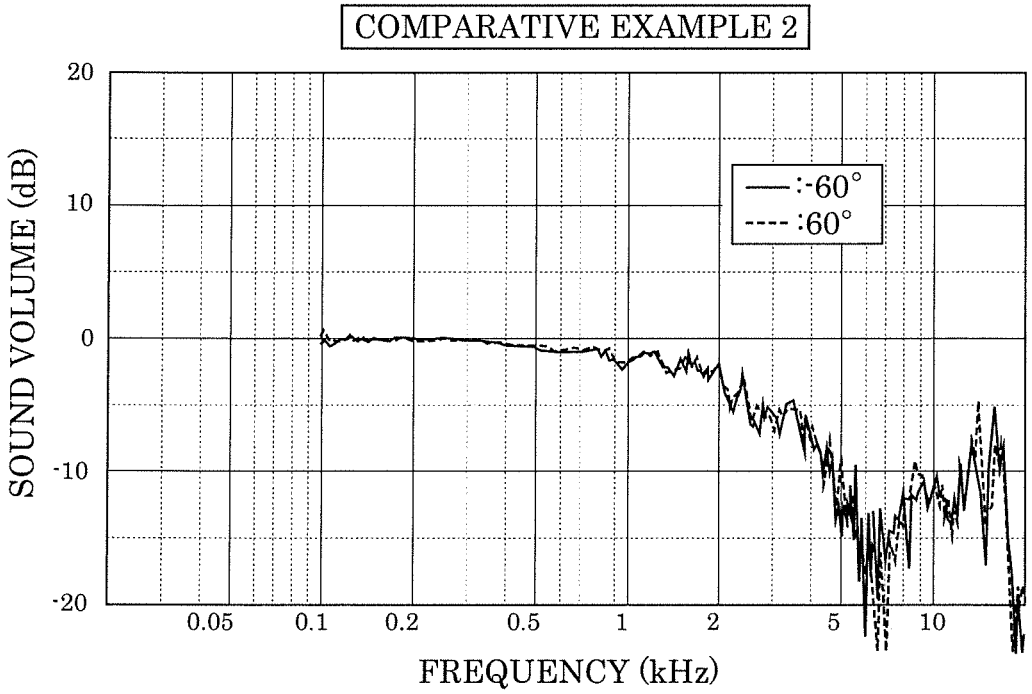
FIG. 9A is a graph showing a comparison between frequency characteristics in ±60-degree directions in Comparative Example 2.
Figure 9B:
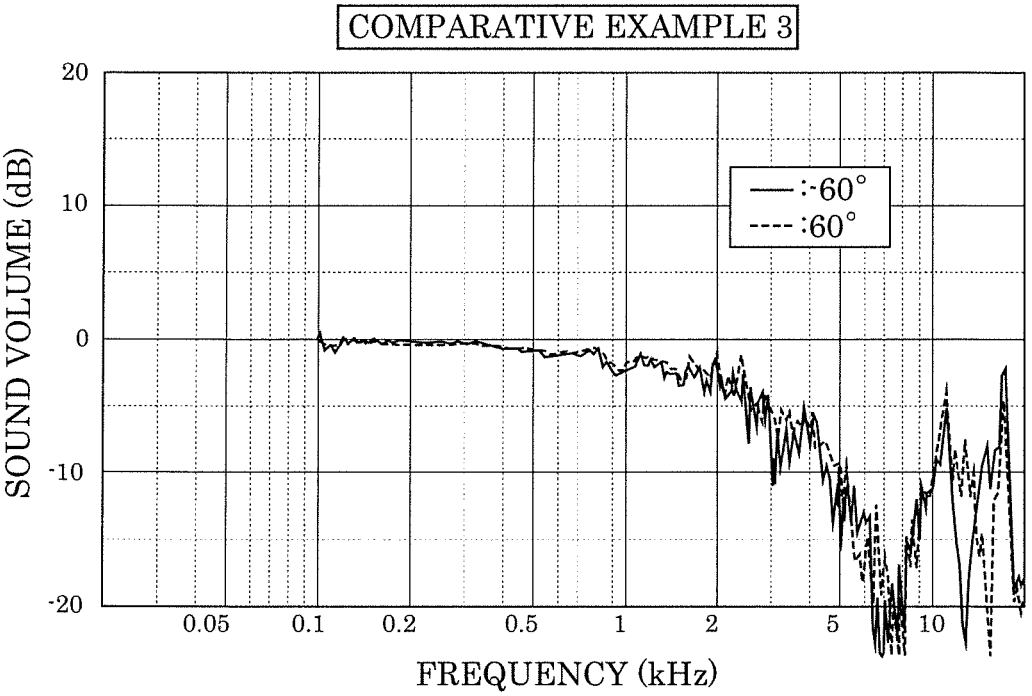
FIG. 9B is a graph showing a comparison between frequency characteristics in ±60-degree directions in Comparative Example 3.
Figure 9C:
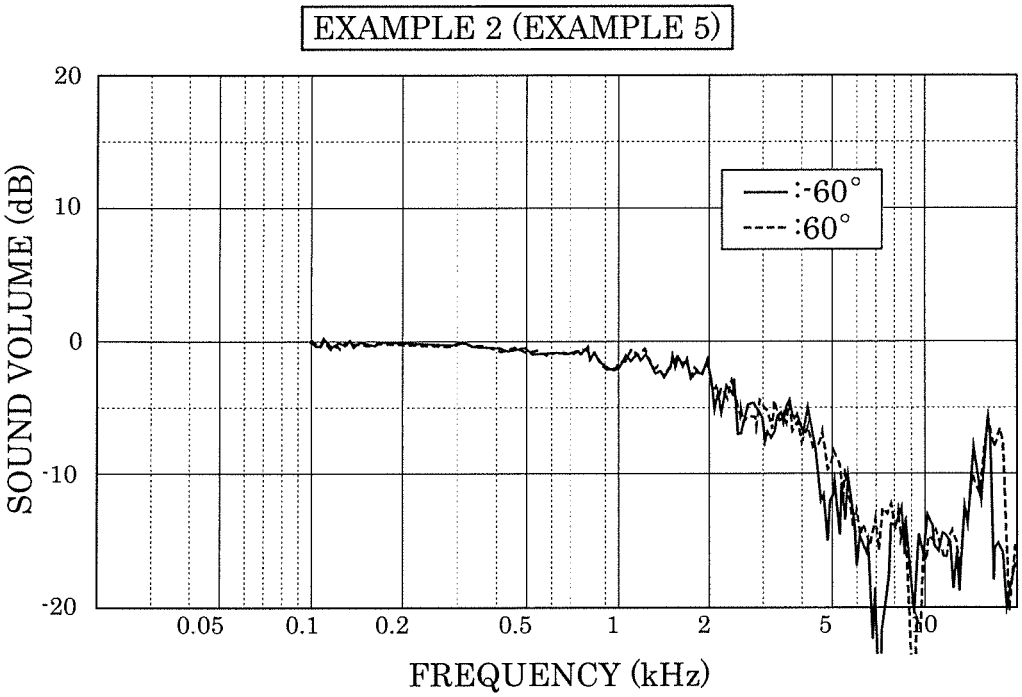
FIG. 9C is a graph showing a comparison between frequency characteristics in ±60-degree directions in Example 2 (Example 5).

FIG. 6A is a perspective view of horn speaker 2 according to Example 1. FIG. 6B is a perspective view of horn speaker 2 according to Example 2. FIG. 7A is a perspective view of speaker 4 according to Comparative Example 1 (Conventional Technique Example 1). FIG. 7B is a cross-sectional perspective view of horn for speakers 50 according to Comparative Example 2 (Conventional Technique Example 2). FIG. 7C is a cross-sectional perspective view of horn for speakers 64 according to Comparative Example 3 (Conventional Technique Example 3). FIG. 8A shows polar patterns indicating directivity characteristics in Comparative Example 1. FIG. 8B shows polar patterns indicating directivity characteristics in Comparative Example 2. FIG. 8C shows polar patterns indicating directivity characteristics in Comparative Example 3. FIG. 8D shows polar patterns indicating directivity characteristics in Example 1. FIG. 8E shows polar patterns indicating directivity characteristics in Example 2. FIG. 9A is a graph showing a comparison between frequency characteristics in ±60-degree directions in Comparative Example 2. FIG. 9B is a graph showing a comparison between frequency characteristics in ±60-degree directions in Comparative Example 3. FIG. 9C is a graph showing a comparison between frequency characteristics in ±60-degree directions in Example 2.

In Example 1, horn speaker 2A was used that included speaker 4 and horn for speakers 6A shown in FIG. 6A. In horn for speakers 6A according to Example 1, second opening 34A of horn body 24A had a square shape with a side length of 60 mm, and each of four corners 36A of second opening 34A had a right-angled shape. Moreover, diameter d of diaphragm 10 of speaker 4 was 38 mm, and the diameter of first opening 28 of horn body 24A was 38 mm. A length from first end portion 26 to second end portion 32 of horn body 24A along the central axis direction was 25 mm.

In Example 2, horn speaker 2 was used that included speaker 4 and horn for speakers 6 shown in FIG. 6B. In horn for speakers 6 according to Example 2, second opening 34 of horn body 24 had a side length of 60 mm. Moreover, each of four corners 36 of second opening 34 had a radiused shape and radius of curvature r of 15 mm. The other conditions for horn for speakers 6 according to Example 2 were the same as Example 1.

In Comparative Example 1 (Conventional Technique Example 1), only speaker 4 shown in FIG. 7A was used, and a horn for speakers was not used.

In Comparative Example 2 (Conventional Technique Example 2), a horn speaker was used that included speaker 4 shown in FIG. 7A and horn for speakers 50 shown in FIG. 7B. As shown in FIG. 7B, in horn for speakers 50 according to Comparative Example 2, first end portion 52 of horn body 51 included first opening 54 having a circular shape, and the diameter of first opening 54 was 38 mm. Second end portion 56 of horn body 51 included second opening 58 having a square shape, and the side length of second opening 58 was 60 mm. Each of four corners 60 of second opening 58 had a right-angled shape. In a cross section including the central axis of horn body 51, the inner surface of sound path 62 flared out in a straight line from first opening 54 toward second opening 58, that is, had a conical shape. A length from first end portion 52 to second end portion 56 of horn body 51 along the central axis direction was 25 mm.

In Comparative Example 3 (Conventional Technique Example 3), a horn speaker was used that included speaker 4 shown in FIG. 7A and horn for speakers 64 shown in FIG. 7C. As shown in FIG. 7C, in horn for speakers 64 according to Comparative Example 3, first end portion 66 of horn body 65 included first opening 68 having a circular shape, and the diameter of first opening 68 was 38 mm. Second end portion 70 of horn body 65 included second opening 72 having an approximately square shape, and the side length of second opening 72 was 60 mm. Each of four corners 74 of second opening 72 had a radiused shape and a radius of curvature of 15 mm. In a cross section including the central axis of horn body 65, the inner surface of sound path 76 flared out in a straight line from first opening 68 toward second opening 72, that is, had a conical shape. A length from first end portion 66 to second end portion 70 of horn body 65 along the central axis direction was 25 mm.

The directivity characteristics in Comparative Examples 1 to 3 and Examples 1 and 2 were as shown in FIG. 8A to FIG. 8E, respectively. FIG. 8A to FIG. 8E each show polar patterns that are created by collecting sound while making a 360-degree turn around speaker 4 constantly at a distance of 1 m from speaker 4 on a plane including the central axis of diaphragm 10 of speaker 4 and that represent the resultant directivity characteristics in circle graphs. The upper, right, lower, and left directions of each circle graph indicate a 0-degree direction (a 360-degree direction), a 90-degree direction, a 180-degree direction, and a 270-degree direction, respectively. In FIG. 8A to FIG. 8E, polar patterns (a) to (j) indicate directivity characteristics in frequency components of 3.5 kHz, 4.0 kHz, 4.5 kHz, 5.0 kHz, 5.6 kHz, 6.3 kHz, 7.1 kHz, 8.0 kHz, 9.0 kHz, and 10 kHz, respectively.

In Comparative Example 1, as shown in (a) to (j) in FIG. 8A, the polar pattern for each frequency component had a shape similar to a circular shape. From this, it was found difficult to obtain the narrow directivity characteristics by using only speaker 4.

In Comparative Example 2, as shown in (a) to (j) in FIG. 8B, the polar pattern for each frequency component had a shape similar to an elliptical shape rather than to the circular shape, compared to Comparative Example 1. From this, it was found possible to obtain the narrow directivity characteristics by attaching horn for speakers 50 to speaker 4. As shown in (j) in FIG. 8B, however, relatively large side lobes occurred with the frequency component of 10 kHz.

In Comparative Example 3, as shown in (a) to (j) in FIG. 8C, the polar pattern for each of the frequency components of 5.0 to 10 kHz had a shape fairly similar to the elliptical shape, compared to Comparative Example 2. From this, it was found possible to increase the directivity characteristics of the mid- to high-frequency ranges of 5.0 to 10 kHz by forming each of four corners 74 of second opening 72 of horn body 65 into a radiused shape. As shown in (j) in FIG. 8C, however, relatively large side lobes occurred with the frequency component of 10 kHz.

In Example 1, as shown in (a) to (j) in FIG. 8D, the polar pattern for each of the frequency components of 5.0 to 10 kHz had a shape very similar to the elliptical shape, compared to Comparative Examples 2 and 3. From this, it was found possible to increase the directivity characteristics of the mid- to high-frequency ranges of 5.0 to 10 kHz by forming the inner surface of the sound path of the horn body in the quartic curve. In particularly, as shown in (j) in FIG. 8D, the side lobes, which had occurred with the frequency component of 10 kHz, significantly decreased, compared to Comparative Examples 2 and 3.

In Example, 2, as shown in (a) to (j) in FIG. 8E, the polar pattern for each of the frequency components of 5.0 to 10 kHz had a shape very much similar to the elliptical shape, compared to Example 1. From this, it was found possible to further increase the directivity characteristics of the mid- to high-frequency ranges of 5.0 to 10 kHz by forming each of four corners 36 of second opening 34 of horn body 24 into the radiused shape.

Results of comparison between frequency characteristics in ±60-degree directions in Comparative Examples 2 and 3 and Example 2 were as shown in FIG. 9A to FIG. 9C. In FIG. 9A to FIG. 9C, the solid line indicates the frequency characteristics in the −60-degree direction, and the broken line indicates the frequency characteristics in the +60-degree direction.

In Comparative Example 3, as shown in FIG. 9A and FIG. 9B, a difference between the frequency characteristics in the −60-degree direction and the frequency characteristics in the +60-degree direction increased in the mid- to high-frequency ranges of 5.0 to 10 kHz, compared to Comparative Example 2. This was considered to result from forming each of four corners 74 of second opening 72 of horn body 65 into the radiused shape in Comparative Example 3.

Moreover, in Example 2, as shown in FIG. 9B and FIG. 9C, a difference between the frequency characteristics in the −60-degree direction and the frequency characteristics in the +60-degree direction increased very much in the mid- to high-frequency ranges of 5.0 to 10 kHz, compared to Comparative Example 3. This was considered to result from forming the inner surface of sound path 38 of horn body 24 in the quartic curve in Example 2.

4-2. Experiment 2

Next, Experiment 2 will be described with reference to FIG. 8E, FIG. 9C, and FIG. 10A through FIG. 11E. Experiment 2 was conducted to evaluate how the length of a horn body of a horn for speakers affects directivity characteristics.

Figure 10A:
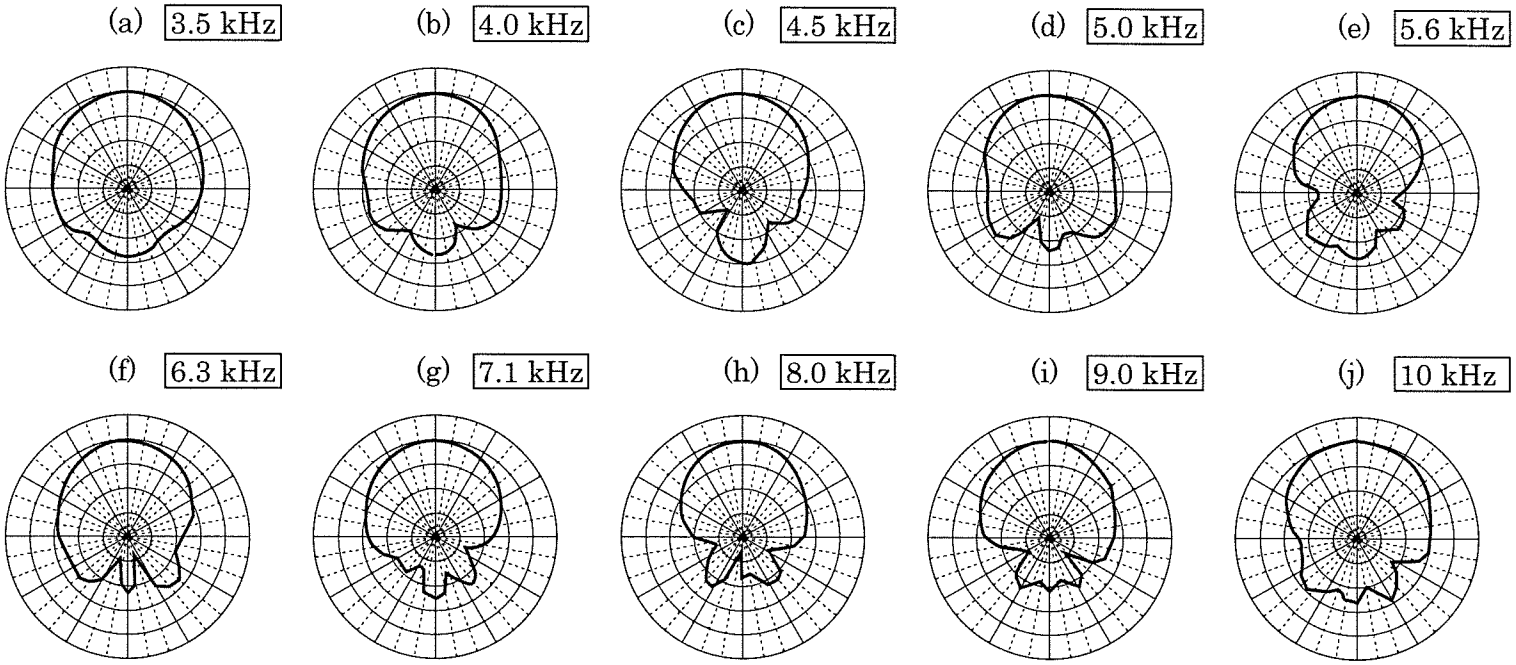
FIG. 10A shows polar patterns indicating directivity characteristics in Comparative Example 4.
Figure 10B:
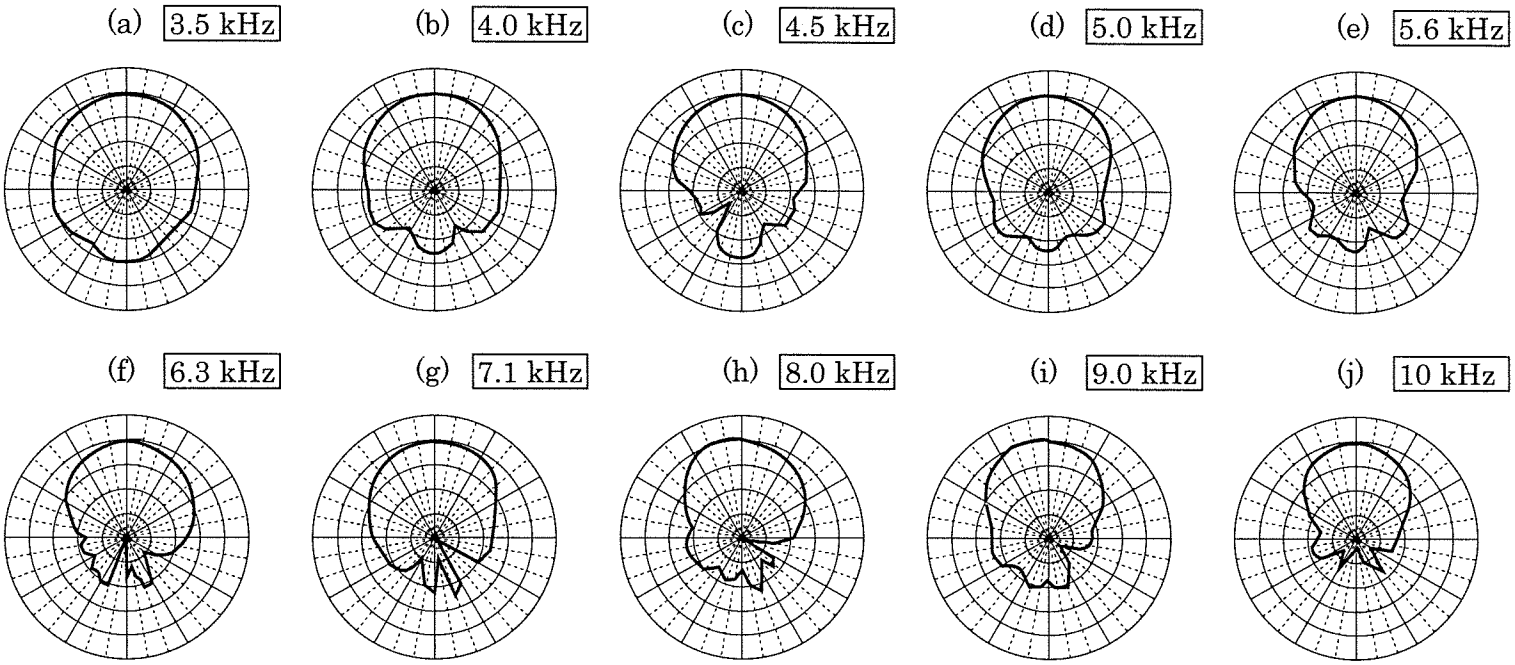
FIG. 10B shows polar patterns indicating directivity characteristics in Comparative Example 5.
Figure 10C:
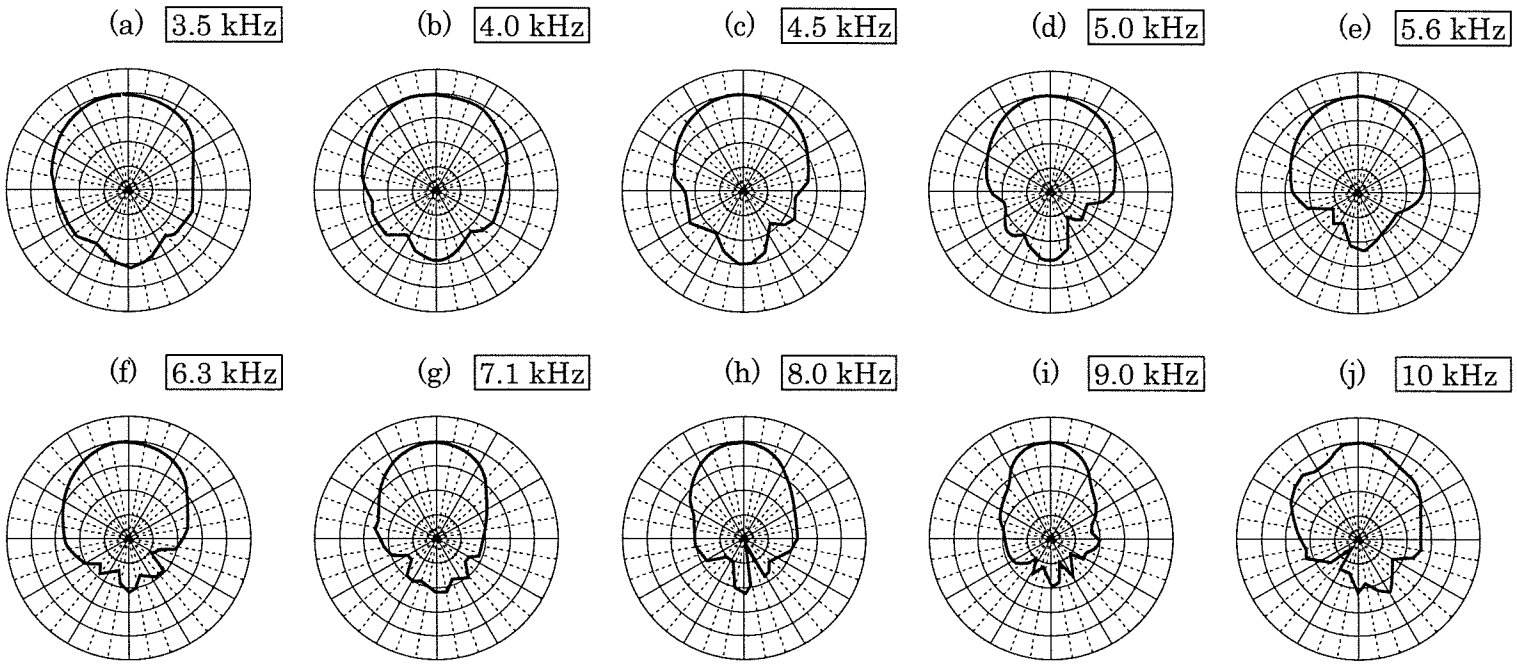
FIG. 10C shows polar patterns indicating directivity characteristics in Example 3.
Figure 10D:
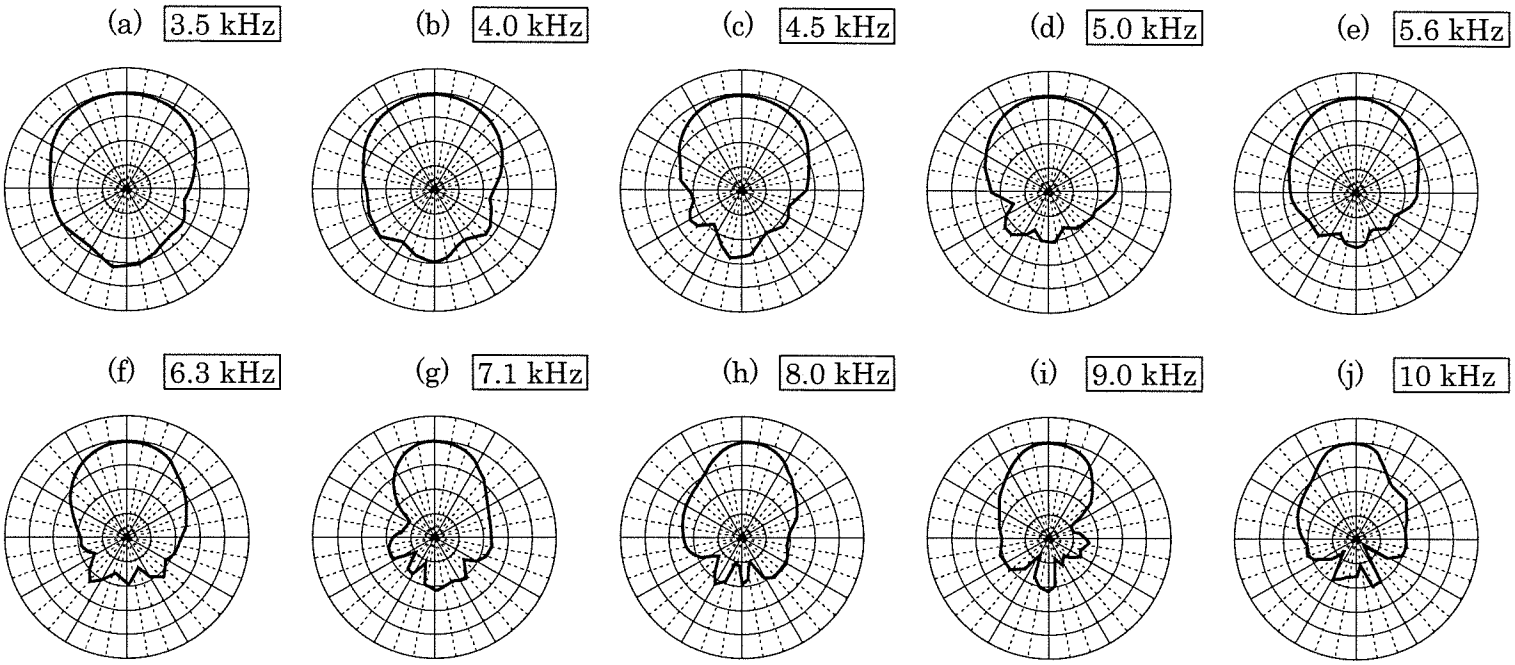
FIG. 10D shows polar patterns indicating directivity characteristics in Example 4.
Figure 10E:
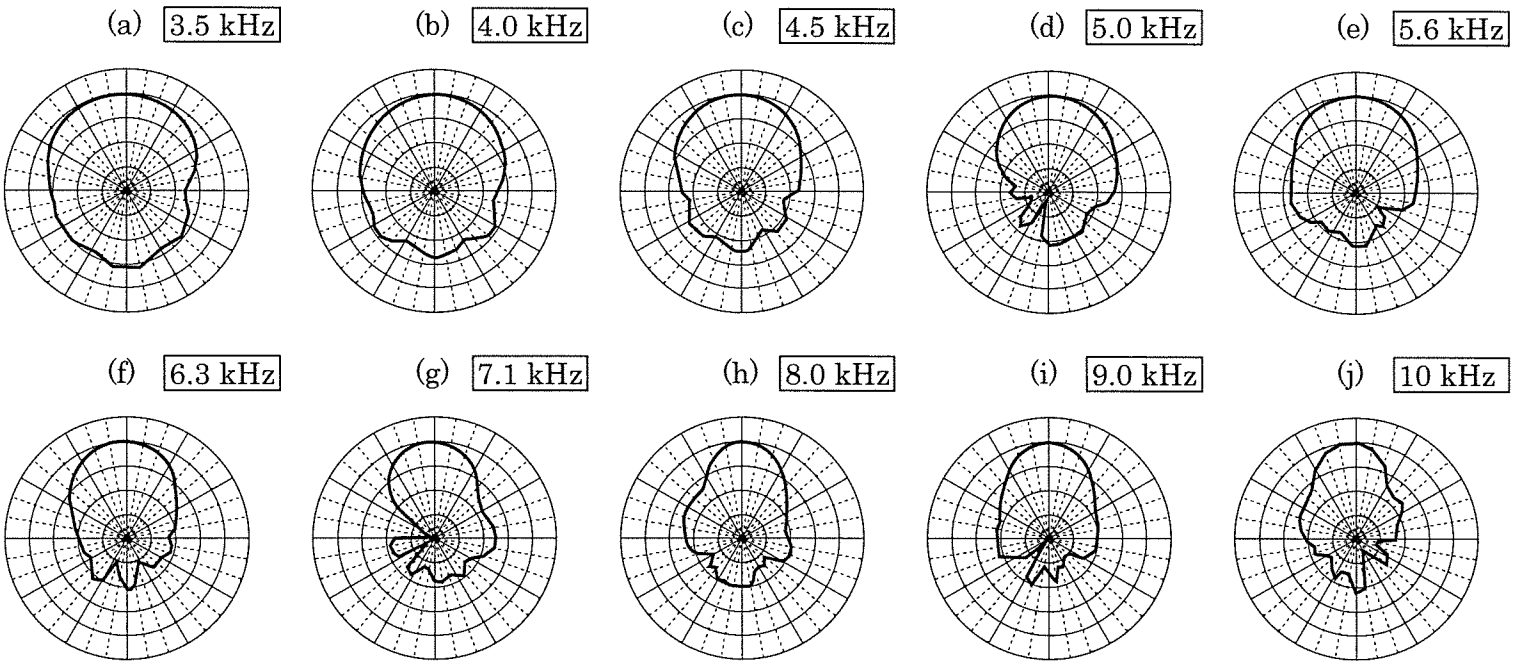
FIG. 10E shows polar patterns indicating directivity characteristics in Example 6.
Figure 11A:
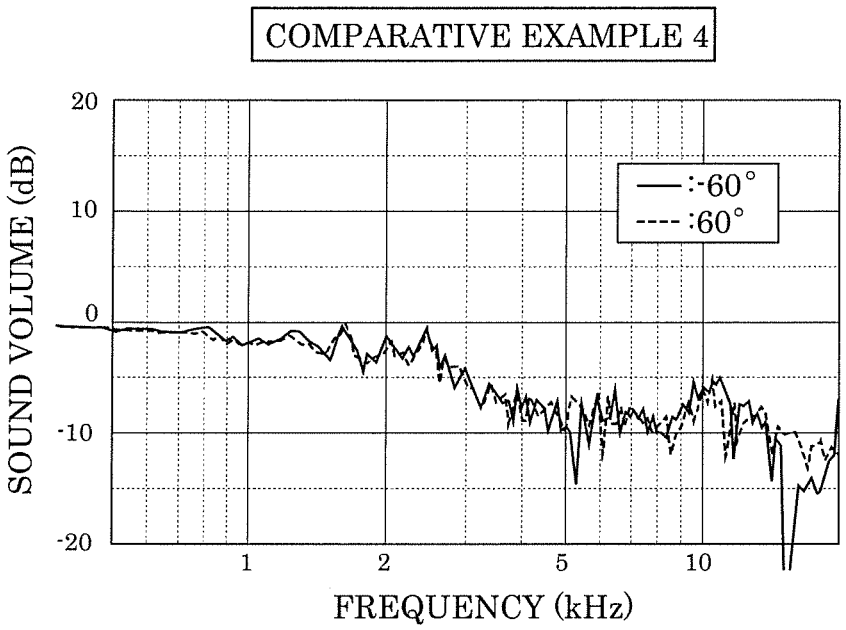
FIG. 11A is a graph showing a comparison between frequency characteristics in ±60-degree directions in Comparative Example 4.
Figure 11B:
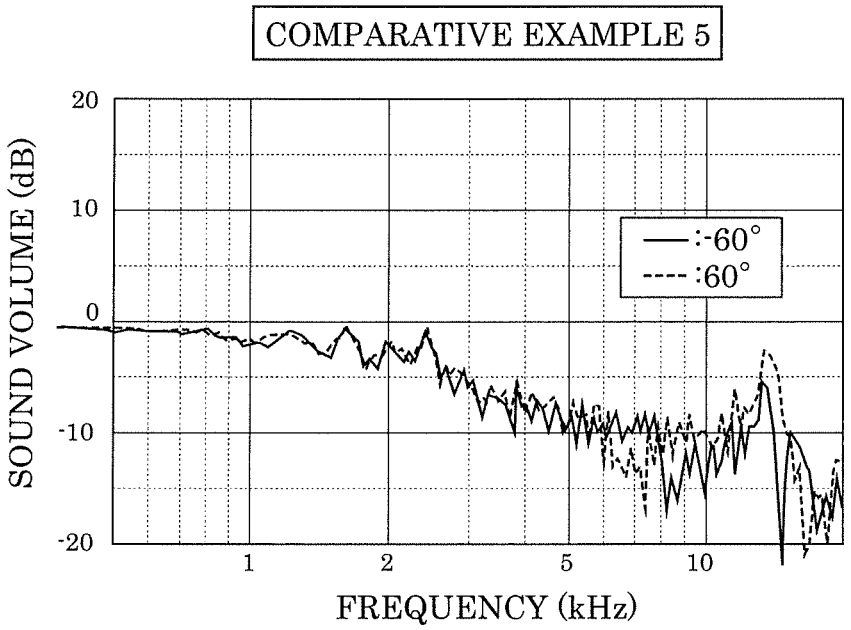
FIG. 11B is a graph showing a comparison between frequency characteristics in ±60-degree directions in Comparative Example 5.
Figure 11C:
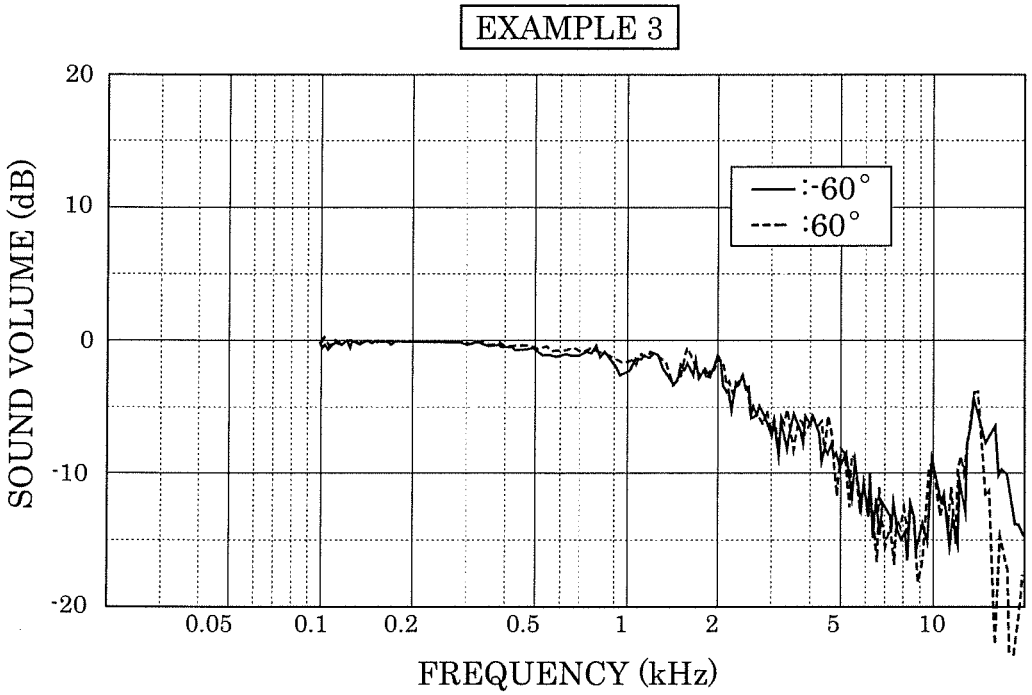
FIG. 11C is a graph showing a comparison between frequency characteristics in ±60-degree directions in Example 3.
Figure 11D:
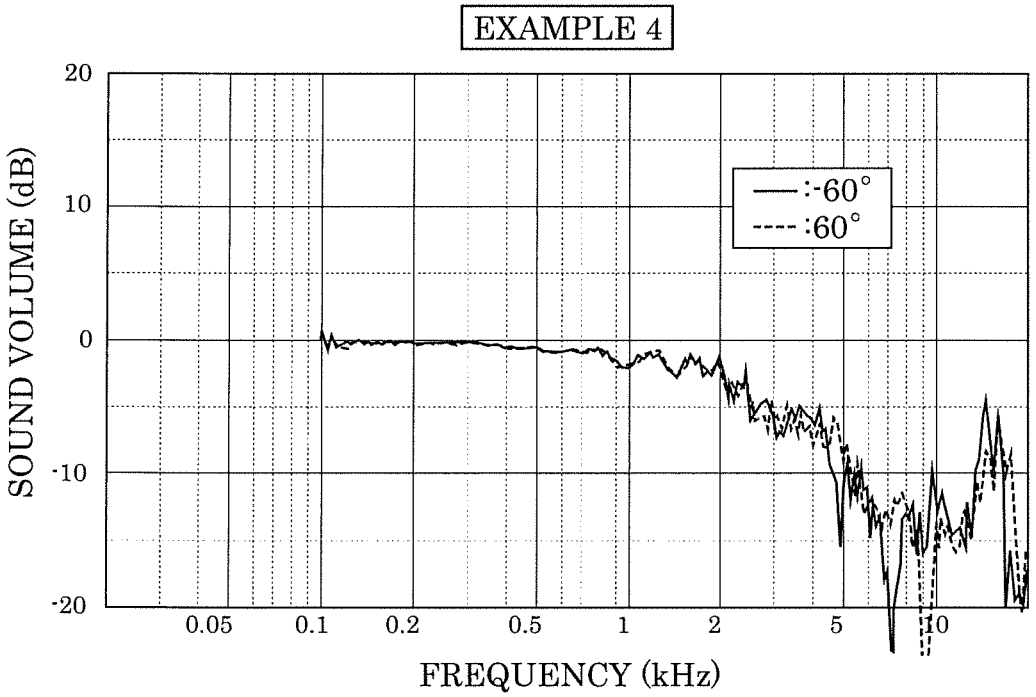
FIG. 11D is a graph showing a comparison between frequency characteristics in ±60-degree directions in Example 4.
Figure 11E:
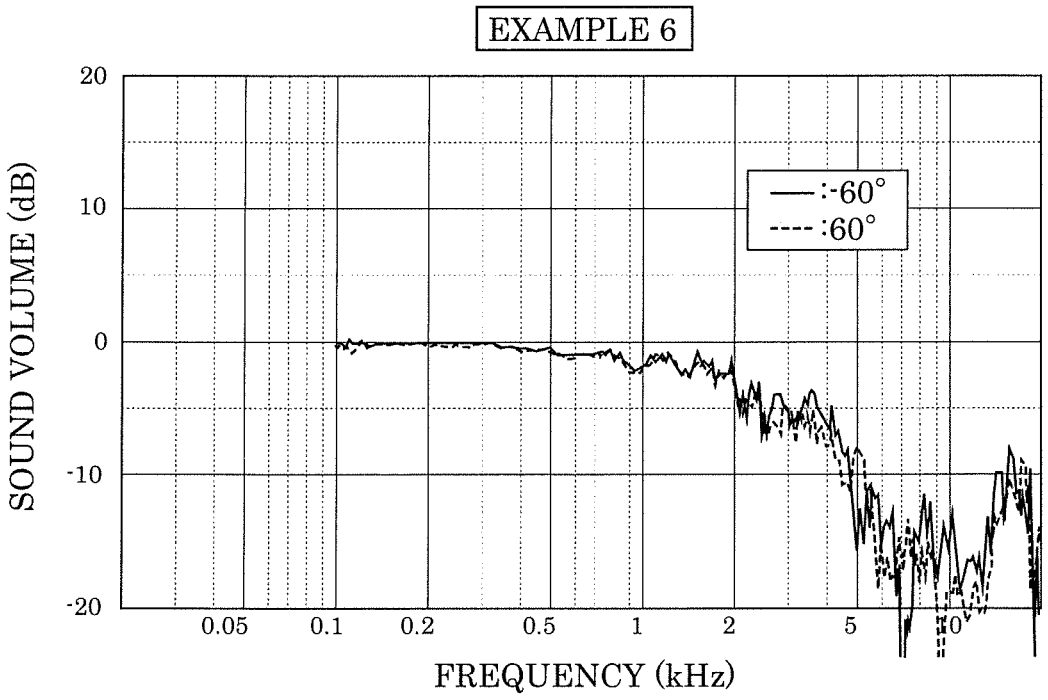
FIG. 11E is a graph showing a comparison between frequency characteristics in ±60-degree directions in Example 6.

FIG. 8E shows polar patterns indicating directivity characteristics in Example 5. FIG. 9C is a graph showing a comparison between frequency characteristics in ±60-degree directions in Example 5. FIG. 10A shows polar patterns indicating directivity characteristics in Comparative Example 4. FIG. 10B shows polar patterns indicating directivity characteristics in Comparative Example 5. FIG. 10C shows polar patterns indicating directivity characteristics in Example 3. FIG. 10D shows polar patterns indicating directivity characteristics in Example 4. FIG. 10E shows polar patterns indicating directivity characteristics in Example 6. FIG. 11A is a graph showing a comparison between frequency characteristics in ±60-degree directions in Comparative Example 4. FIG. 11B is a graph showing a comparison between frequency characteristics in ±60-degree directions in Comparative Example 5. FIG. 11C is a graph showing a comparison between frequency characteristics in ±60-degree directions in Example 3. FIG. 11D is a graph showing a comparison between frequency characteristics in ±60-degree directions in Example 4. FIG. 11E is a graph showing a comparison between frequency characteristics in ±60-degree directions in Example 6.

In Example 3, a horn speaker was used that included above-described speaker 4 shown in FIG. 6B, and a horn for speakers including a horn body having a different length from horn body 24 of above-described horn for speakers 6 shown in FIG. 6B. In the horn for speakers according to Example 3, a length from a first end portion to a second end portion of the horn body along the central axis direction was 15 mm (0.8 times as large as the radius of a first opening).

In Example 4, a horn speaker was used that included speaker 4 shown in FIG. 6B, and a horn for speakers including a horn body having a different length from horn body 24 of horn for speakers 6 shown in FIG. 6B. In the horn for speakers according to Example 4, a length from a first end portion to a second end portion of the horn body along the central axis direction was 20 mm (1.1 times as large as the radius of a first opening).

In Example 5, horn speaker 2 was used that included speaker 4 and horn for speakers 6 shown in FIG. 6B, like Example 2 in above-described Experiment 1. In horn for speakers 6 according to Example 5, a length from first end portion 26 to second end portion 32 of horn body 24 along the central axis direction was 25 mm (1.3 times as large as the radius of the first opening).

In Example 6, a horn speaker was used that included speaker 4 shown in FIG. 6B, and a horn for speakers including a horn body having a different length from horn body 24 of horn for speakers 6 shown in FIG. 6B. In the horn for speakers according to Example 6, a length from a first end portion to a second end portion of the horn body along the central axis direction was 30 mm (1.6 times as large as the radius of a first opening).

In Comparative Example 4, a horn speaker was used that included speaker 4 shown in FIG. 6 B, and a horn for speakers including a horn body having a different length from horn body 24 of horn for speakers 6 shown in FIG. 6B. In the horn for speakers according to Comparative Example 4, a length from a first end portion to a second end portion of the horn body along the central axis direction was 5 mm (0.3 times as large as the radius of a first opening).

In Comparative Example 5, a horn speaker was used that included speaker 4 shown in FIG. 6B, and a horn for speakers including a horn body having a different length from horn body 24 of horn for speakers 6 shown in FIG. 6B. In the horn for speakers according to Comparative Example 5, a length from a first end portion to a second end portion of the horn body along the central axis direction was 10 mm (0.5 times as large as the radius of a first opening).

In Examples 3 to 6, as shown in above-described FIG. 8E and FIG. 10A to FIG. 10E, the polar pattern for each of the frequency components of 5.0 to 10 kHz had a shape very similar to the elliptical shape, compared to Comparative Examples 4 and 5. From this, it was found possible to increase the directivity characteristics of the mid- to high-frequency ranges of 5.0 to 10 kHz by setting the length of the horn body to at least 15 mm (at least 0.8 times as large as the radius of the first opening).

Moreover, in Examples 3 to 6, as shown in above-described FIG. 9C and FIG. 11A to FIG. 11E, a difference between the frequency characteristics in the −60-degree direction and the frequency characteristics in the +60-degree direction increased in the mid- to high-frequency ranges of 5.0 to 10 kHz, compared to Comparative Examples 4 and 5. This was considered to result from setting the length of the horn body to at least 15 mm in Examples 3 to 6.

4-3. Experiment 3

Next, Experiment 3 will be described with reference to FIG. 12A through FIG. 14B. Experiment 3 was conducted to evaluate how the presence or absence of a horn for speakers affects directivity characteristics when a type of speaker is changed.

Figure 12A:
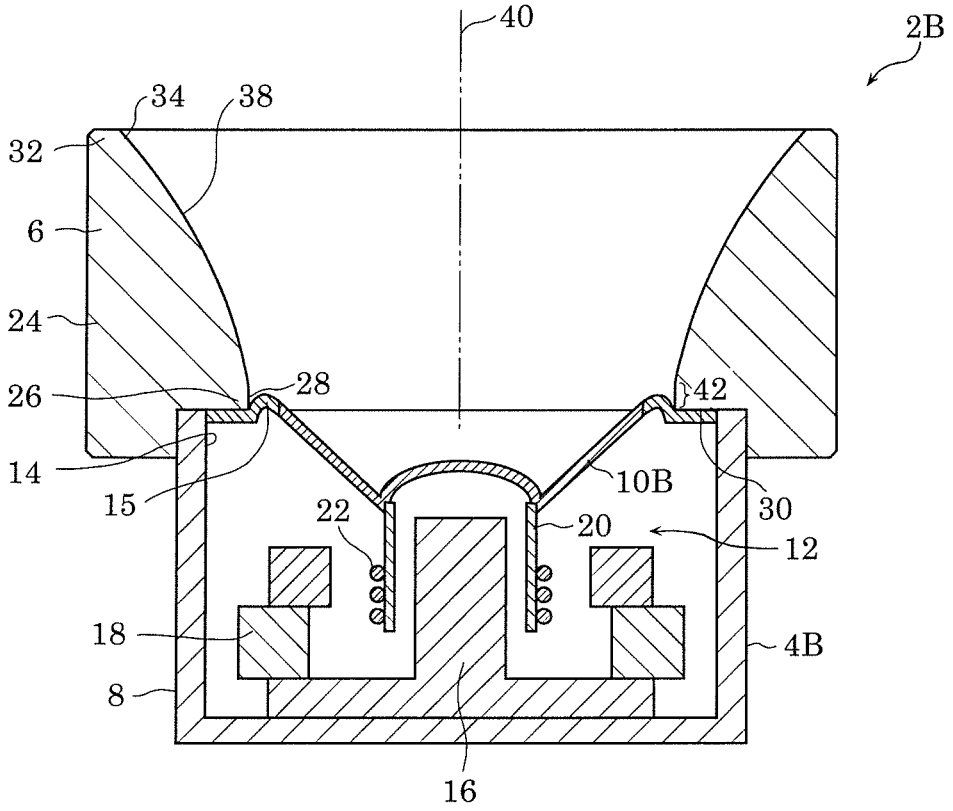
FIG. 12A is a cross-sectional view of a horn speaker according to Example 7.
Figure 12B:
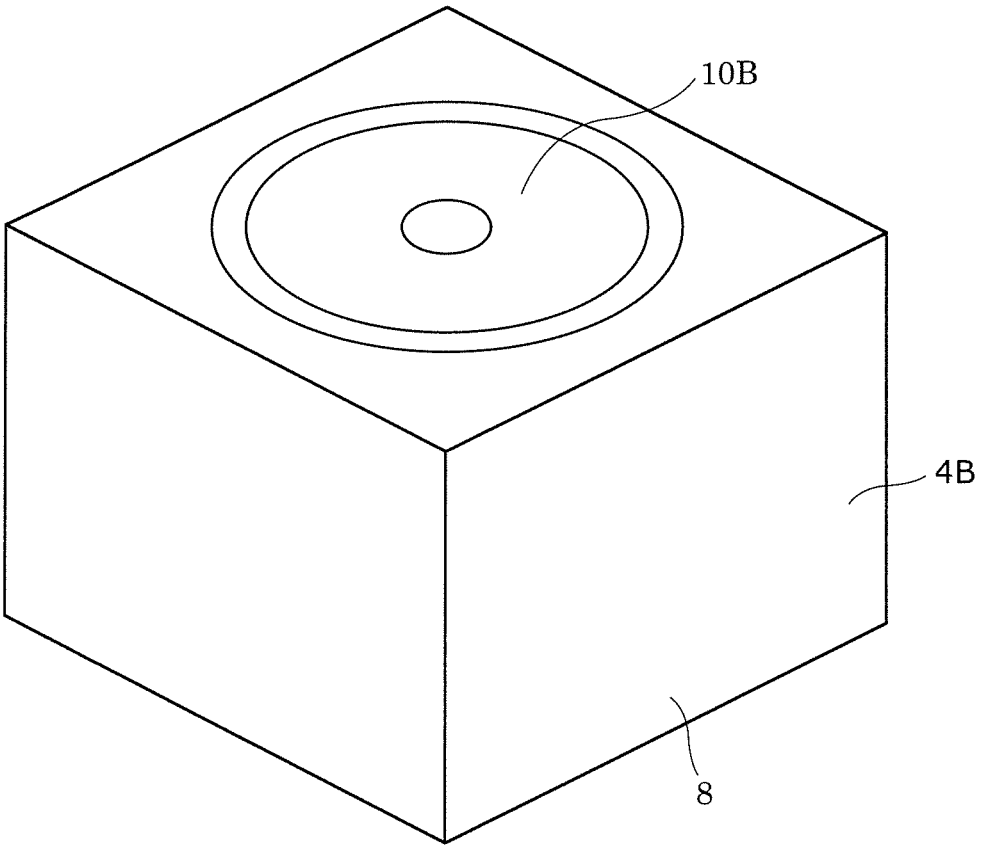
FIG. 12B is a perspective view of a speaker according to Comparative Example 6.
Figure 13A:
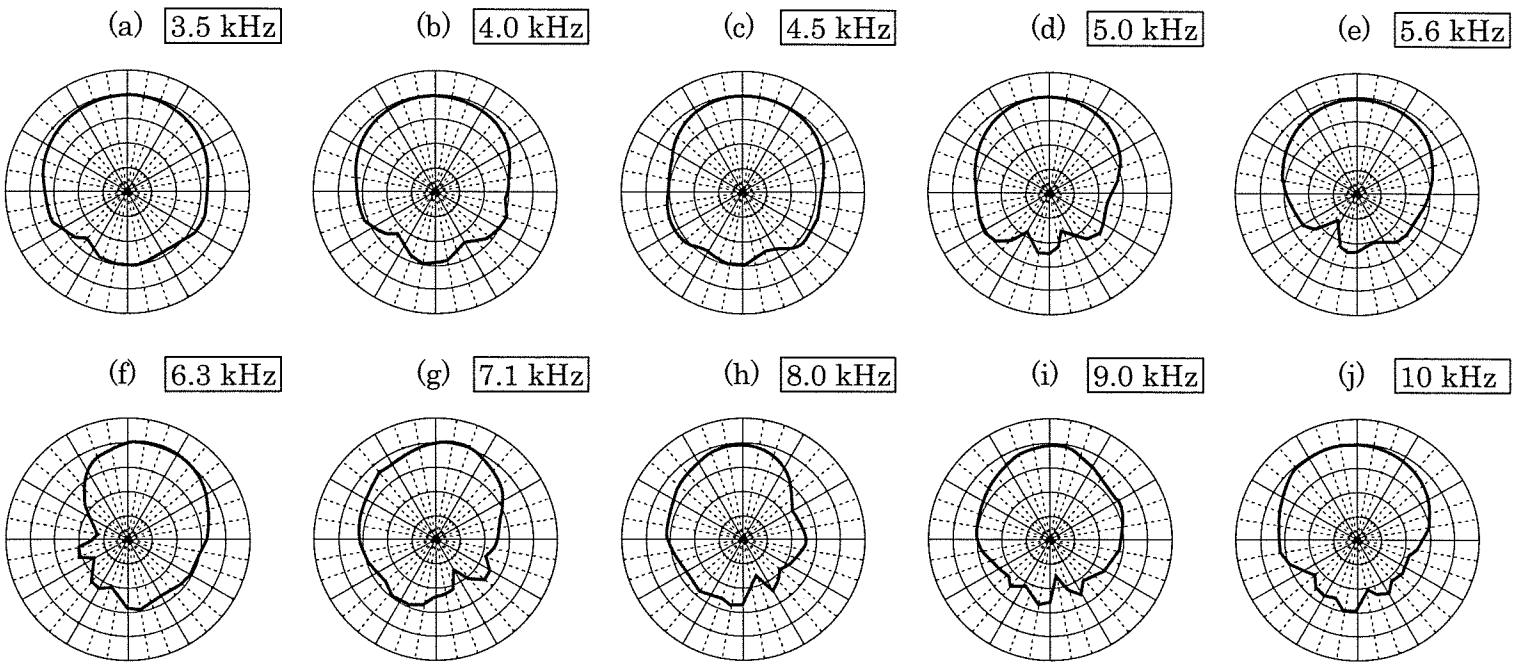
FIG. 13A shows polar patterns indicating directivity characteristics in Comparative Example 6.
Figure 13B:
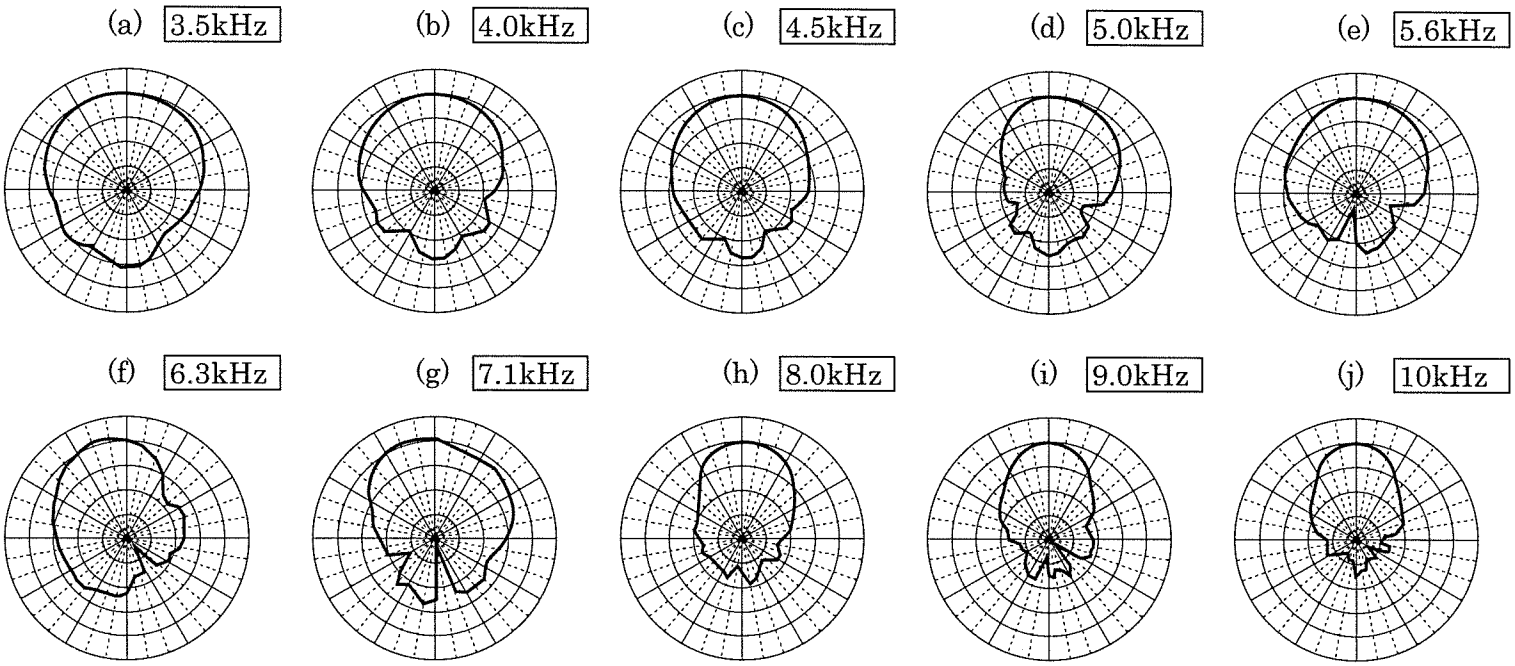
FIG. 13B shows polar patterns indicating directivity characteristics in Example 7.
Figure 14A:
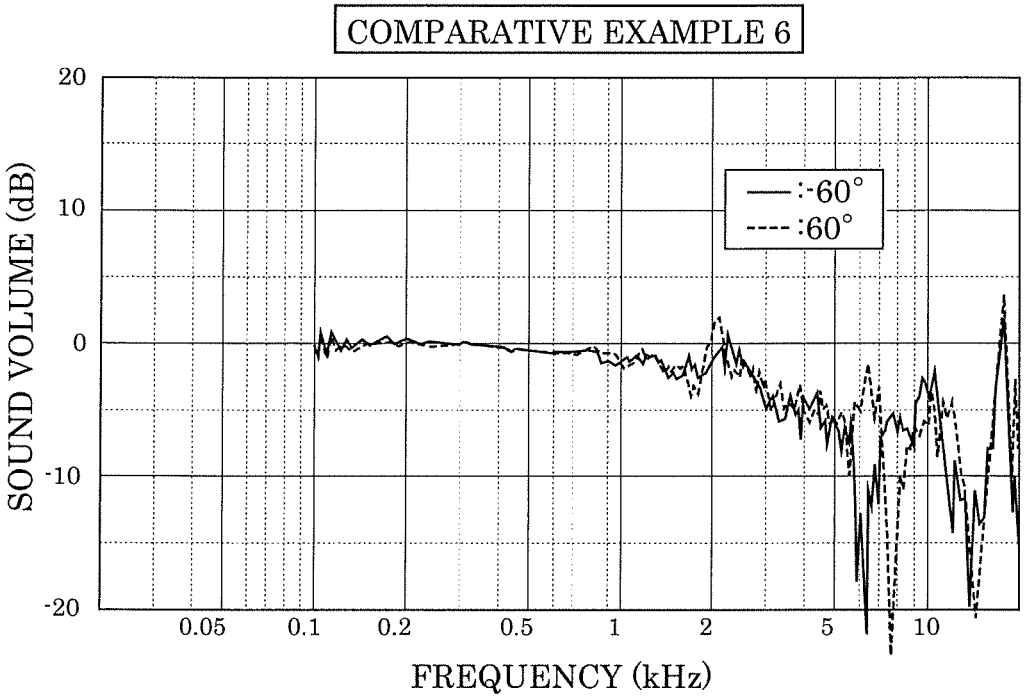
FIG. 14A is a graph showing a comparison between frequency characteristics in ±60-degree directions in Comparative Example 6.
Figure 14B:
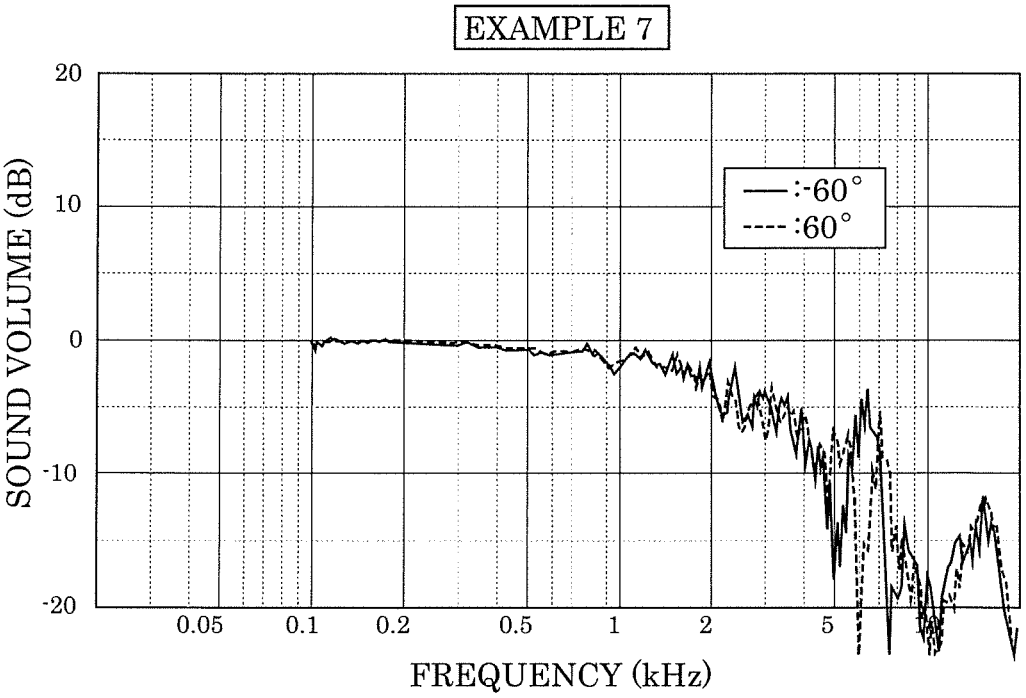
FIG. 14B is a graph showing a comparison between frequency characteristics in ±60-degree directions in Example 7.

FIG. 12A is a cross-sectional view of horn speaker 2B according to Example 7. FIG. 12B is a perspective view of speaker 4B according to Comparative Example 6 (Conventional Technique Example 6). FIG. 13A shows polar patterns indicating directivity characteristics in Comparative Example 6. FIG. 13B shows polar patterns indicating directivity characteristics in Example 7. FIG. 14A is a graph showing a comparison between frequency characteristics in ±60-degree directions in Comparative Example 6. FIG. 14B is a graph showing a comparison between frequency characteristics in ±60-degree directions in Example 7.

In Example 7, horn speaker 2B was used that included speaker 4B and horn for speakers 6 shown in FIG. 12A. In speaker 4B according to Example 7, diaphragm 10B was circular and conical in the XY plan view. The diameter of diaphragm 10B was 38 mm.

In Comparative Example 6 (Conventional Technique Example 6), only speaker 4B shown in FIG. 12B was used, and a horn for speakers was not used.

In Comparative Example 6, as shown in (a) to (j) in FIG. 13A, the polar pattern for each frequency component had a shape similar to a circular shape. From this, it was found difficult to obtain the narrow directivity characteristics by using only the speaker.

In Example 7, as shown in (a) to (j) in FIG. 13B, the polar pattern for each of the frequency components of 5.0 to 10 kHz had a shape similar to an elliptical shape rather than to the circular shape, compared to Comparative Example 6. From this, it was found possible to increase the directivity characteristics of the mid- to high-frequency ranges of 5.0 to 10 kHz by attaching the horn for speakers according to Example 7 to the speaker.

In Example 7, as shown in FIG. 14A and FIG. 14B, a difference between the frequency characteristics in the −60-degree direction and the frequency characteristics in the +60-degree direction increased in the mid- to high-frequency ranges of 5.0 to 10 kHz, compared to Comparative Example 6. This was considered to result from attaching the horn for speakers to the speaker in Example 7.

4-4. Experiment 4

Next, Experiment 4 will be described with reference to FIG. 15 through FIG. 26B. Experiment 4 was conducted to evaluate how the shape of a horn for speakers and the length of a horn body affect directivity characteristics.

Figure 15:
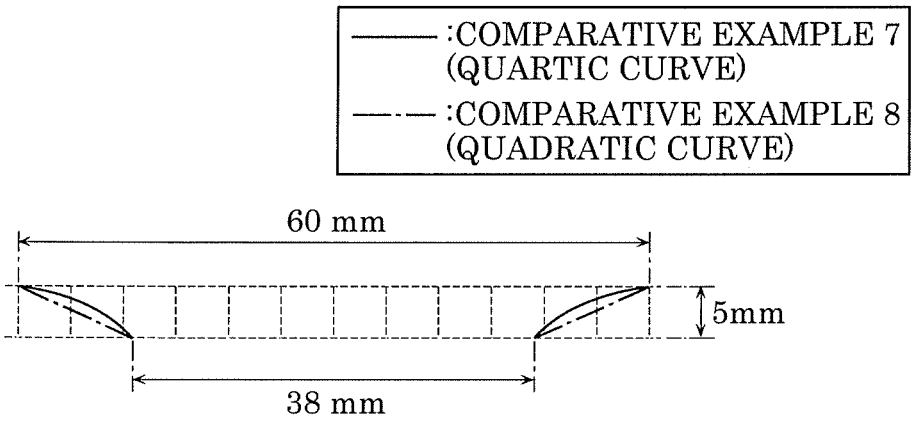
FIG. 15 is a diagram schematically illustrating the inner surface shapes of sound paths of horns for speakers according to Comparative Examples 7 and 8.
Figure 16A:
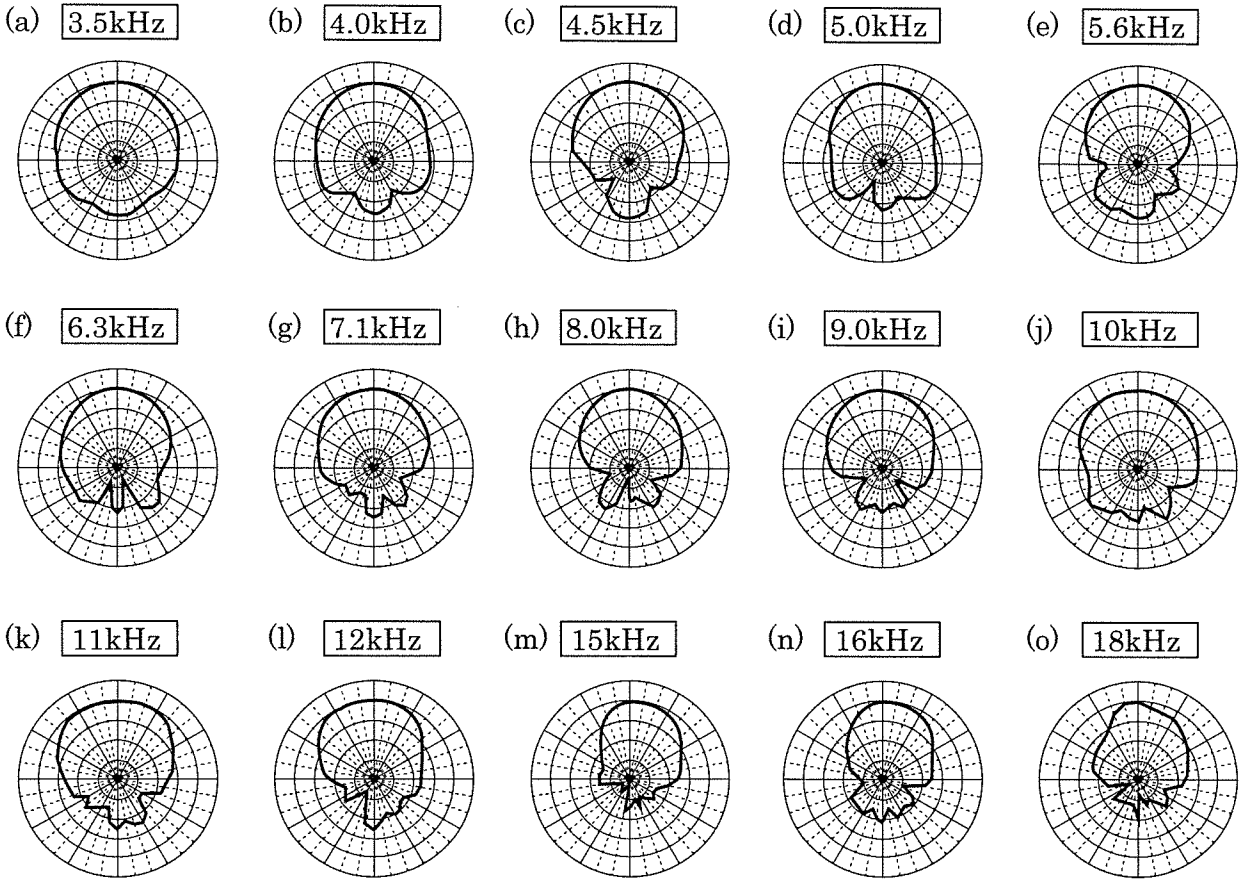
FIG. 16A shows polar patterns indicating directivity characteristics in Comparative Example 7.
Figure 16B:
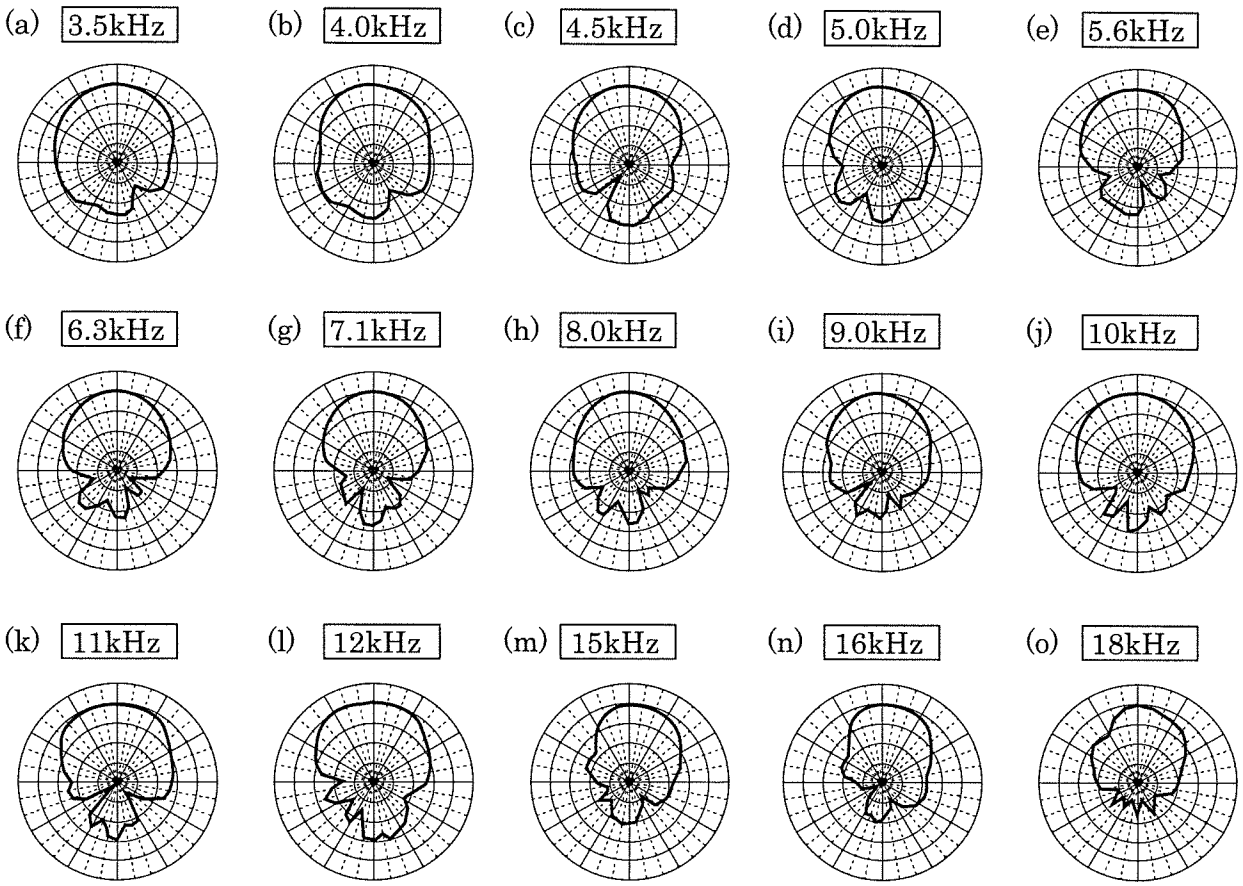
FIG. 16B shows polar patterns indicating directivity characteristics in Comparative Example 8.
Figure 17A:
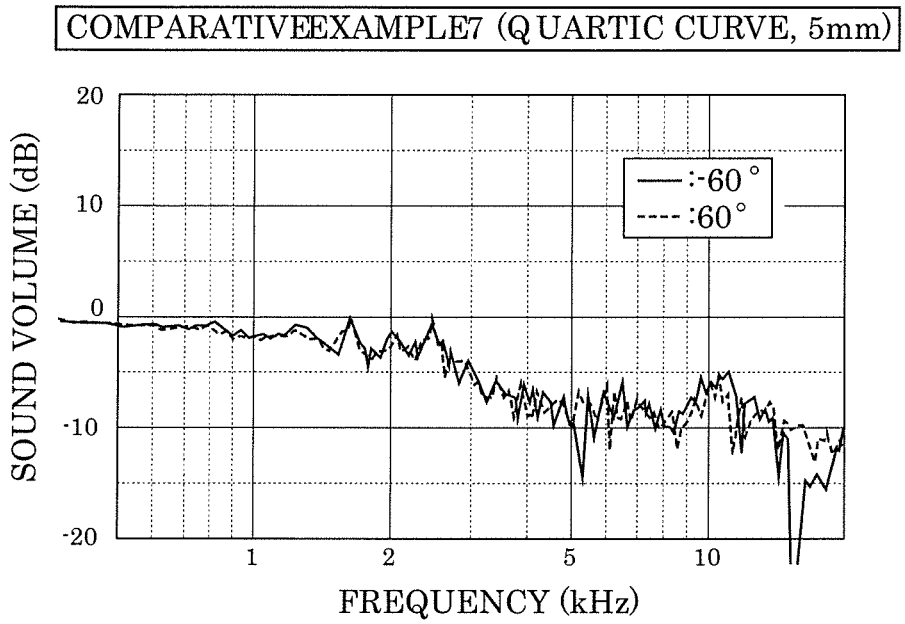
FIG. 17A is a graph showing a comparison between frequency characteristics in ±60-degree directions in Comparative Example 7.
Figure 17B:
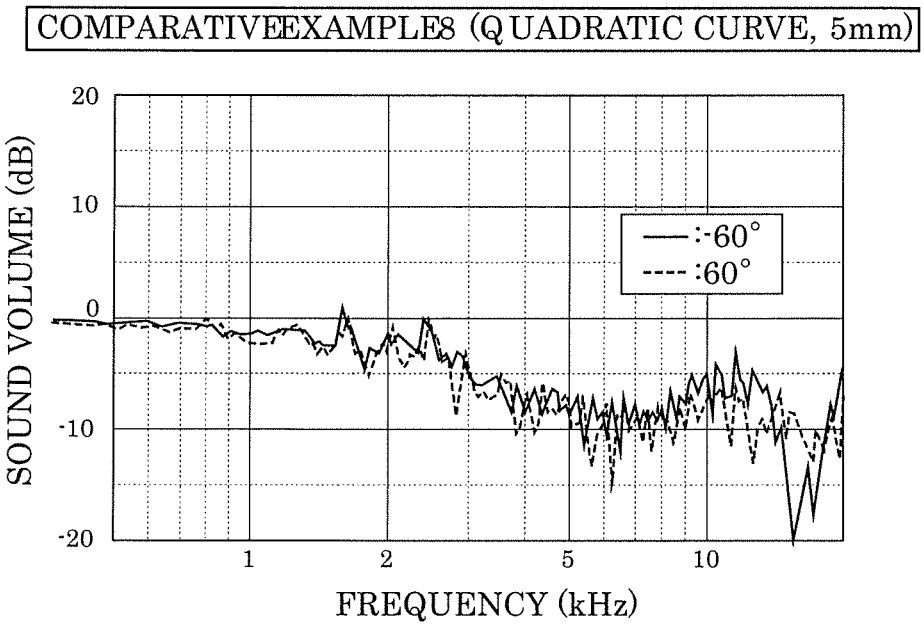
FIG. 17B is a graph showing a comparison between frequency characteristics in ±60-degree directions in Comparative Example 8.

First, Comparative Examples 7 and 8 will be described with reference to FIG. 15 through FIG. 17B. FIG. 15 is a diagram schematically illustrating the inner surface shapes of sound paths of horns for speakers according to Comparative Examples 7 and 8. FIG. 16A shows polar patterns indicating directivity characteristics in Comparative Example 7. FIG. 16B shows polar patterns indicating directivity characteristics in Comparative Example 8. FIG. 17A is a graph showing a comparison between frequency characteristics in ±60-degree directions in Comparative Example 7. FIG. 17B is a graph showing a comparison between frequency characteristics in ±60-degree directions in Comparative Example 8.

In Comparative Example 7, a horn speaker was used that included speaker 4 shown in FIG. 6B, and a horn for speakers including a horn body having a different length from horn body 24 of horn for speakers 6 shown in FIG. 6B. As shown in FIG. 15, in the horn for speakers according to Comparative Example 7, a length from a first end portion to a second end portion of the horn body along the central axis direction was 5 mm (0.3 times as large as the radius of a first opening). Moreover, the inner surface of the sound path of the horn body flared out in the quartic curve from the first opening toward a second opening.

In Comparative Example 8, a horn speaker was used that included speaker 4 shown in FIG. 6B, and a horn for speakers including a horn body having a different length from horn body 24 of horn for speakers 6 shown in FIG. 6B, and a sound path having a different inner surface shape from sound path 38 of horn for speakers 6. As shown in FIG. 15, in the horn for speakers according to Comparative Example 8, a length from a first end portion to a second end portion of the horn body along the central axis direction was 5 mm. Moreover, the inner surface of the sound path of the horn body flared out in the quadratic curve from a first opening toward a second opening.

As shown in FIG. 16A and FIG. 16B, there was little difference in shape of the polar patterns between Comparative Examples 7 and 8. Further, as shown in FIG. 17A and FIG. 17B, both in Comparative Examples 7 and 8, the slopes of the lines in the mid- to high-frequency ranges of 5.0 to 10 kHz were gentle, and the directivity characteristics of the mid- to high-frequency ranges were steady.

Figure 18:
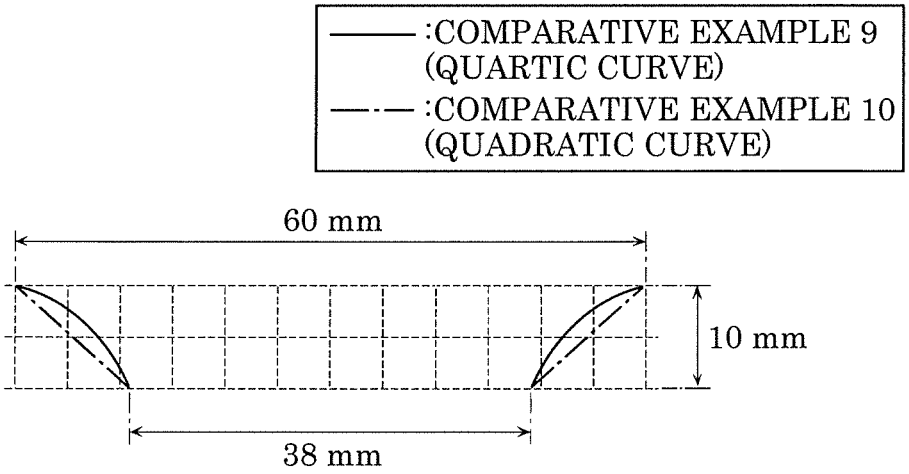
FIG. 18 is a diagram schematically illustrating the inner surface shapes of sound paths of horns for speakers according to Comparative Examples 9 and 10.
Figure 19A:
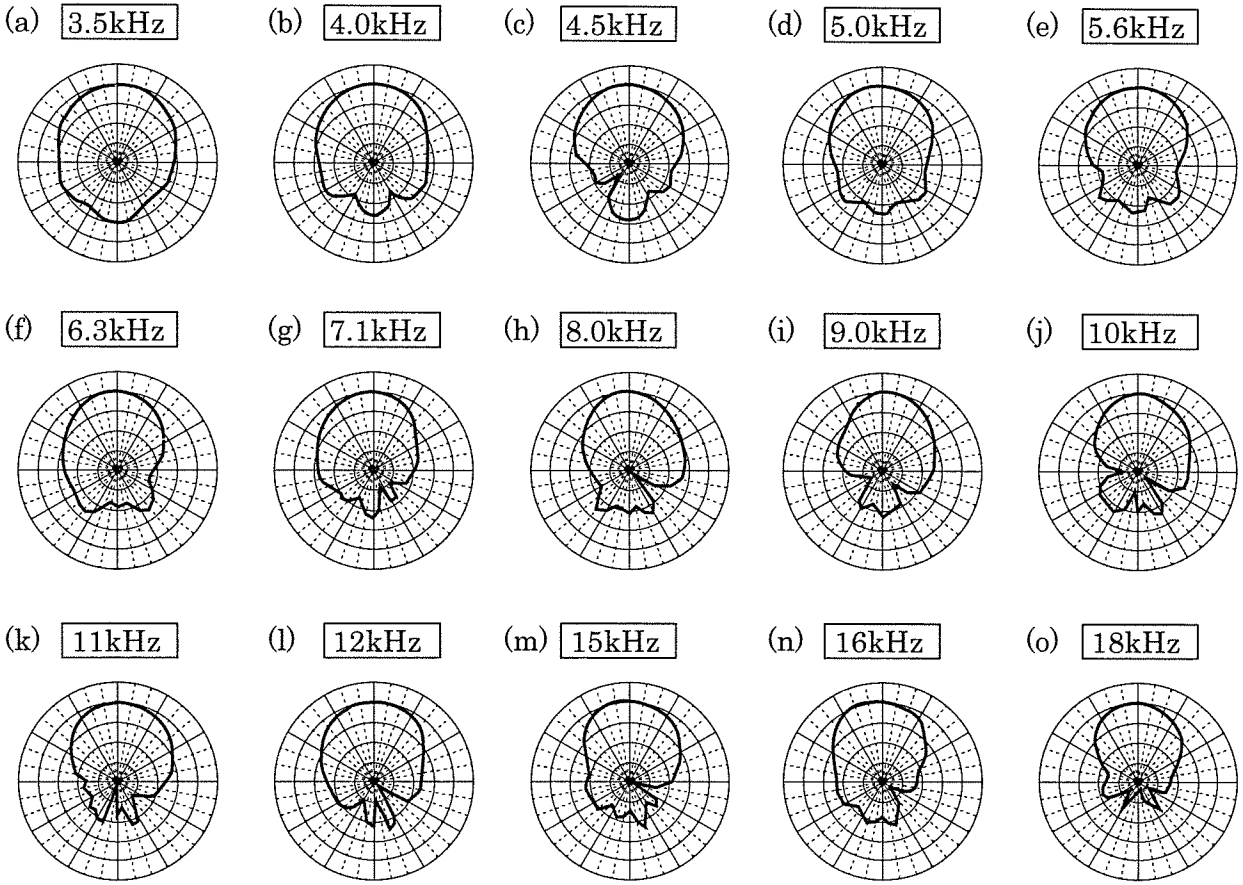
FIG. 19A shows polar patterns indicating directivity characteristics in Comparative Example 9.
Figure 19B:
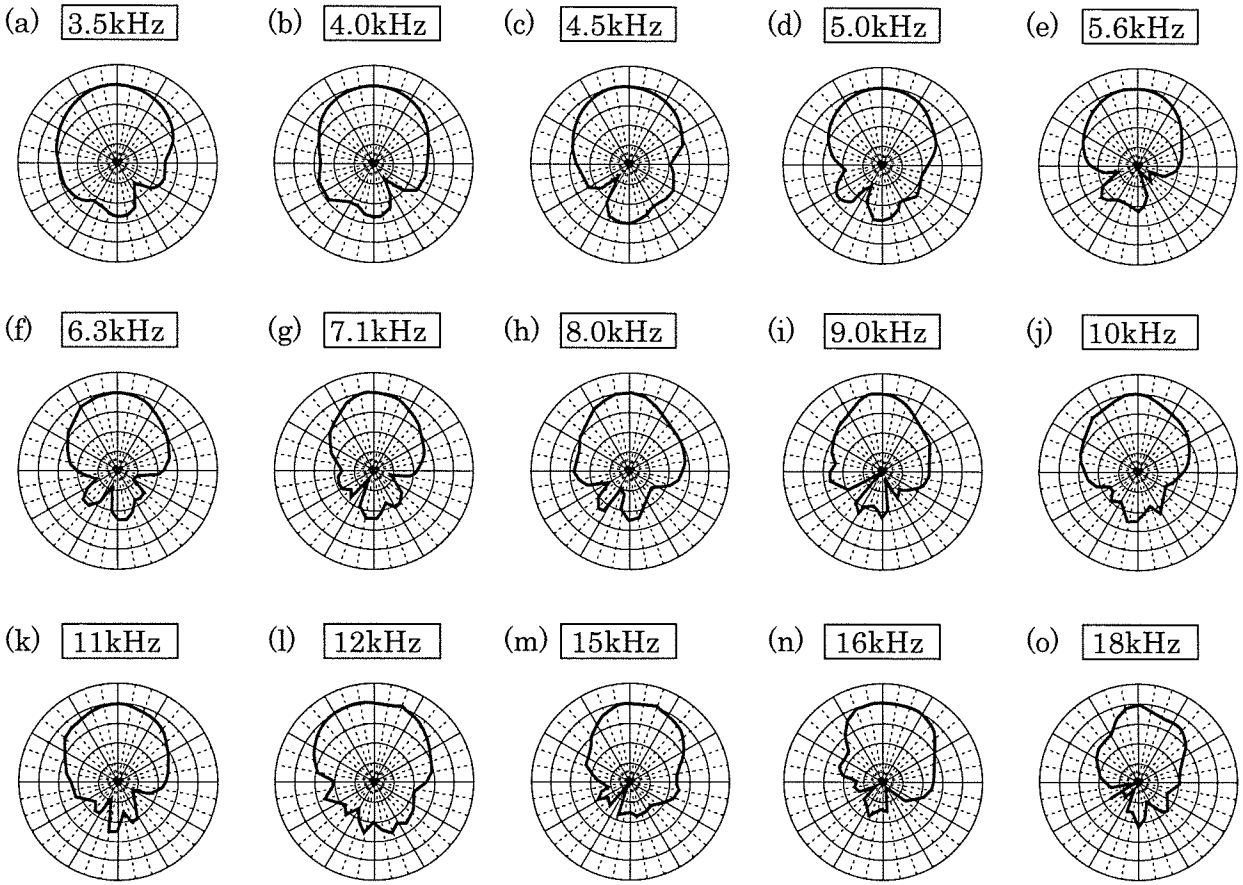
FIG. 19B shows polar patterns indicating directivity characteristics in Comparative Example 10.
Figure 20A:
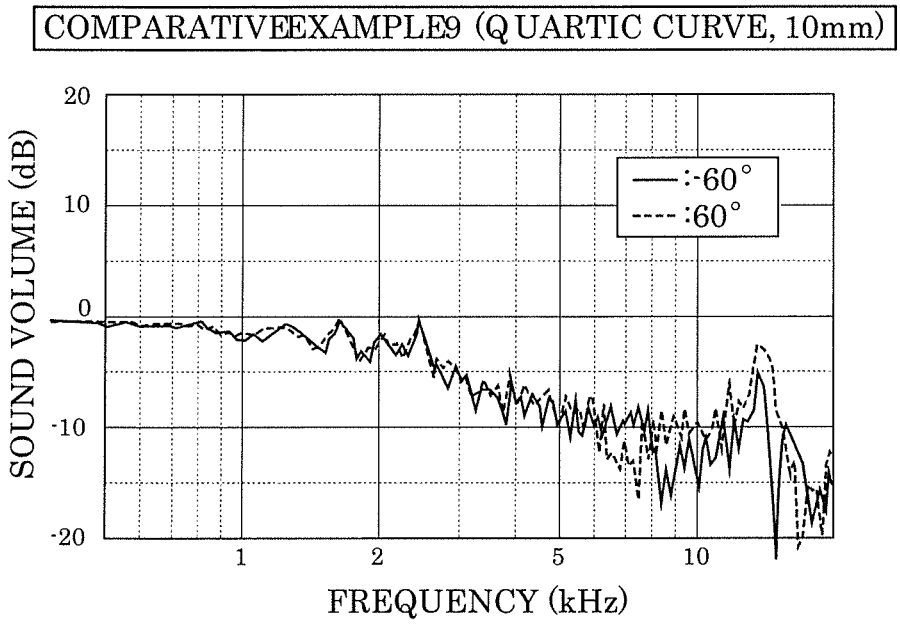
FIG. 20A is a graph showing a comparison between frequency characteristics in ±60-degree directions in Comparative Example 9.
Figure 20B:
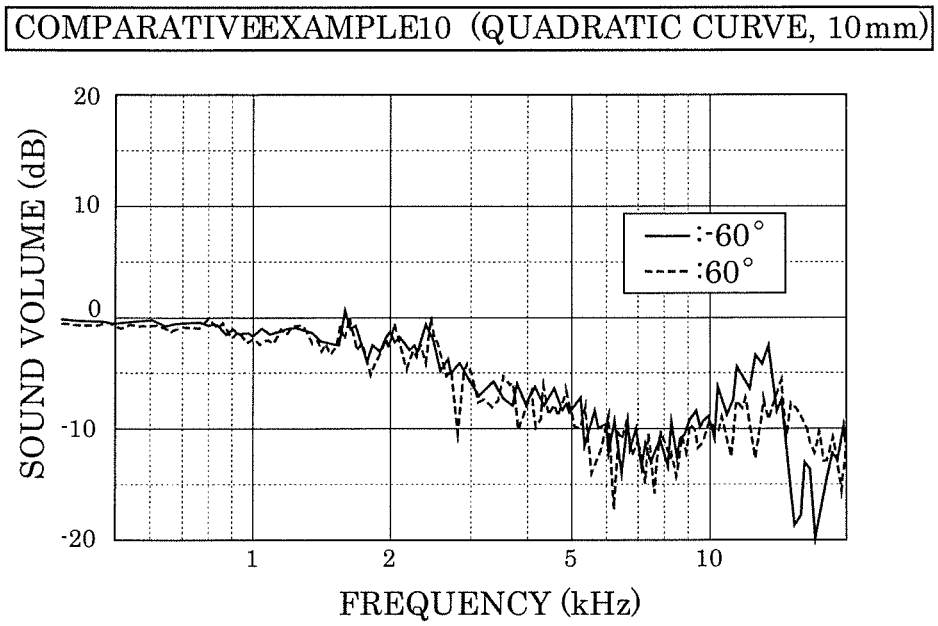
FIG. 20B is a graph showing a comparison between frequency characteristics in ±60-degree directions in Comparative Example 10.

Next, Comparative Examples 9 and 10 will be described with reference to FIG. 18 through FIG. 20B. FIG. 18 is a diagram schematically illustrating the inner surface shapes of sound paths of horns for speakers according to Comparative Examples 9 and 10. FIG. 19A shows polar patterns indicating directivity characteristics in Comparative Example 9. FIG. 19B shows polar patterns indicating directivity characteristics in Comparative Example 10. FIG. 20A is a graph showing a comparison between frequency characteristics in ±60-degree directions in Comparative Example 9. FIG. 20B is a graph showing a comparison between frequency characteristics in ±60-degree directions in Comparative Example 10.

In Comparative Example 9, a horn speaker was used that included speaker 4 shown in FIG. 6B, and a horn for speakers including a horn body having a different length from horn body 24 of horn for speakers 6 shown in FIG. 6B. As shown in FIG. 18, in the horn for speakers according to Comparative Example 9, a length from a first end portion to a second end portion of the horn body along the central axis direction was 10 mm (0.5 times as large as the radius of a first opening). Moreover, the inner surface of a sound path of the horn body flared out in the quartic curve from the first opening toward a second opening.

In Comparative Example 10, a horn speaker was used that included speaker 4 shown in FIG. 6B, and a horn for speakers including a horn body having a different length from horn body 24 of horn for speakers 6 shown in FIG. 6B, and a sound path having a different inner surface shape from sound path 38 of horn for speakers 6. As shown in FIG. 18, in the horn for speakers according to Comparative Example 10, a length from a first end portion to a second end portion of the horn body along the central axis direction was 10 mm. Moreover, the inner surface of the sound path of the horn body flared out in the quadratic curve from a first opening toward a second opening.

As shown in FIG. 19A and FIG. 19B, there was little difference in shape of the polar patterns between Comparative Examples 9 and 10. Further, as shown in FIG. 20A and FIG. 20B, in Comparative Examples 9 and 10, the slopes of the lines in the mid- to high-frequency ranges of 5.0 to 10 kHz slightly became steep, and the directivity characteristics of the mid- to high-frequency ranges slightly increased, compared to Comparative Examples 7 and 8.

Figure 21:
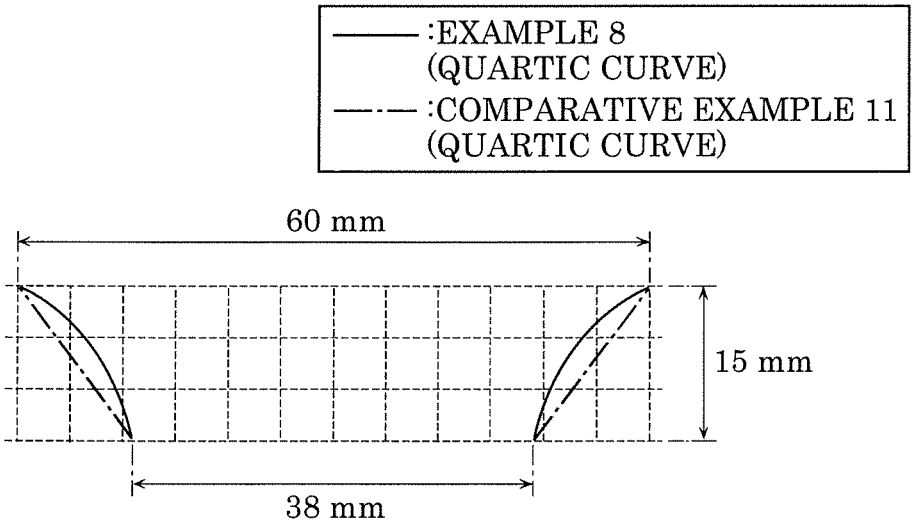
FIG. 21 is a diagram schematically illustrating the inner surface shapes of sound paths of horns for speakers according to Example 8 and Comparative Example 11.
Figure 22A:
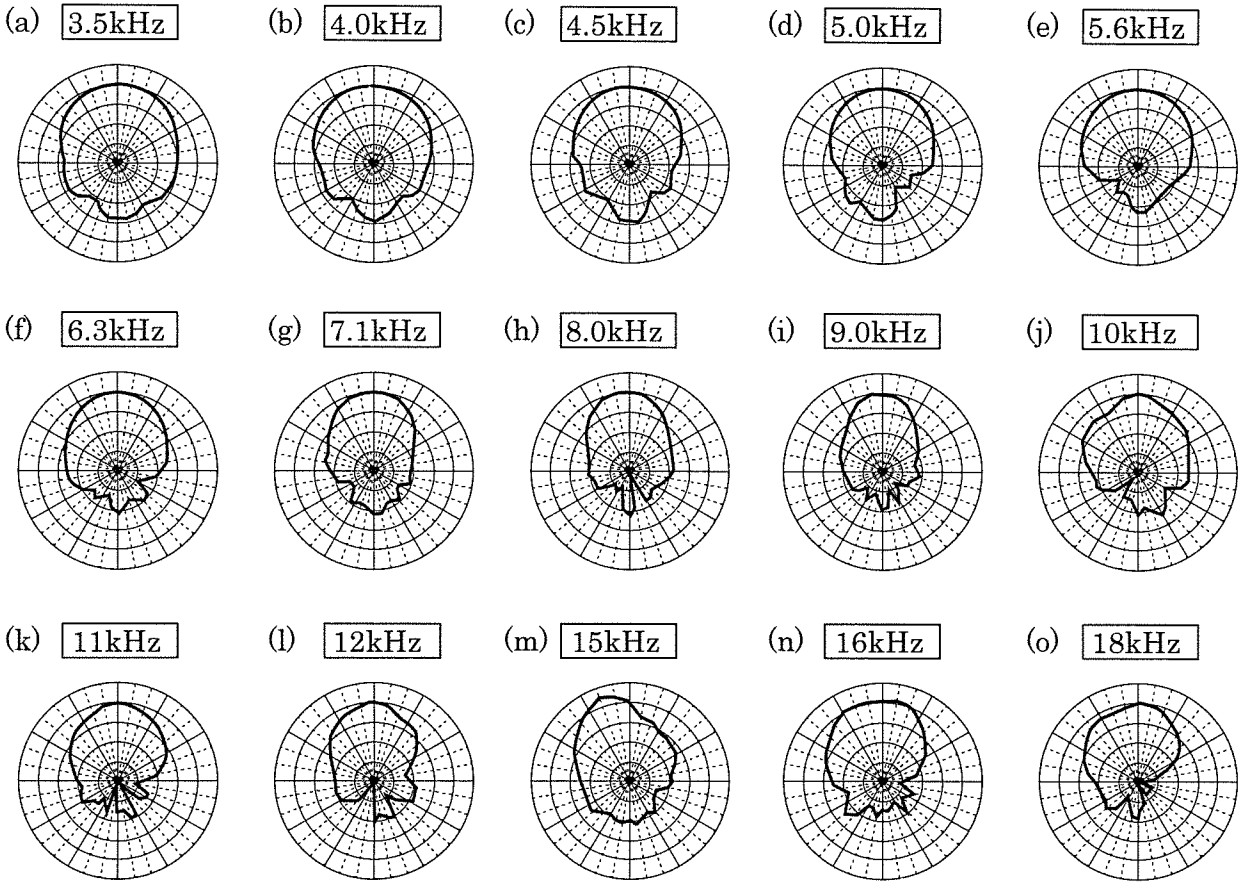
FIG. 22A shows polar patterns indicating directivity characteristics in Example 8.
Figure 22B:
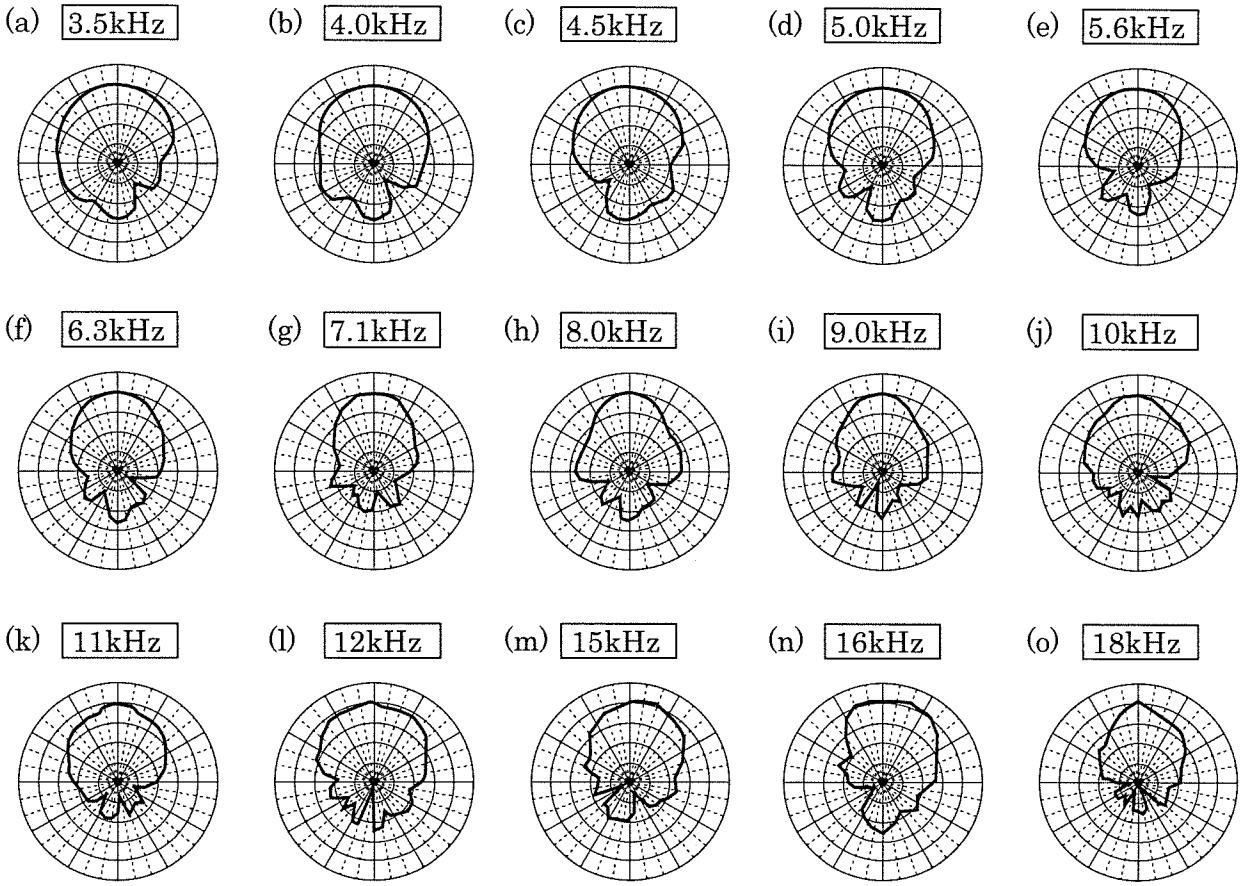
FIG. 22B shows polar patterns indicating directivity characteristics in Comparative Example 11.
Figure 23A:
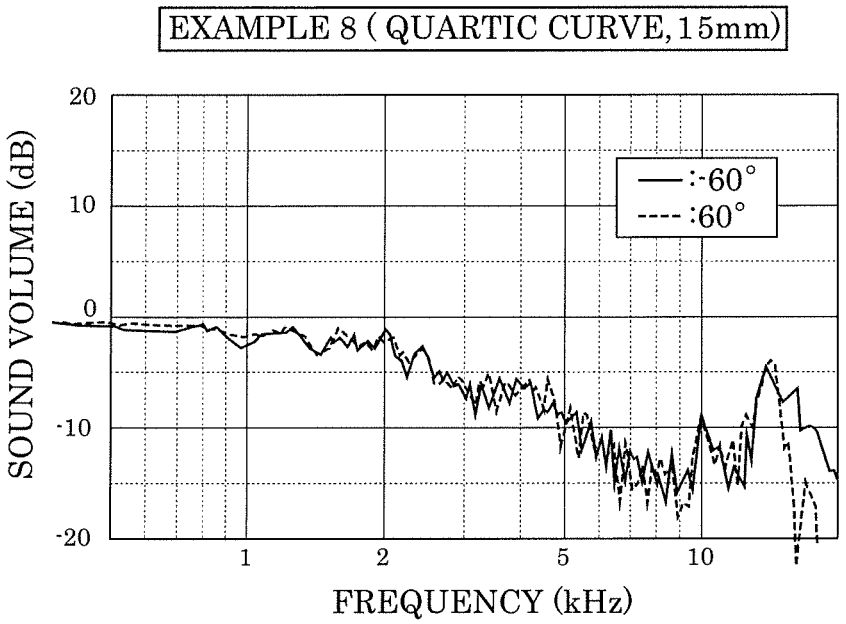
FIG. 23A is a graph showing a comparison between frequency characteristics in ±60-degree directions in Example 8.
Figure 23B:
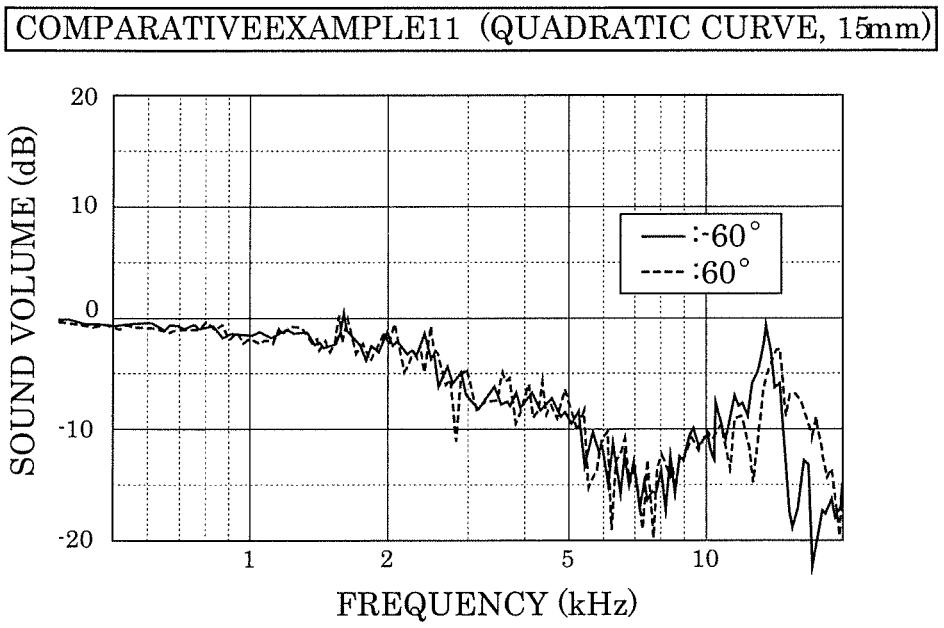
FIG. 23B is a graph showing a comparison between frequency characteristics in ±60-degree directions in Comparative Example 11.

Next, Example 8 and Comparative Example 11 will be described with reference to FIG. 21 through FIG. 23B. FIG. 21 is a diagram schematically illustrating the inner surface shapes of sound paths of horns for speakers according to Example 8 and Comparative Example 11. FIG. 22A shows polar patterns indicating directivity characteristics in Example 8. FIG. 22B shows polar patterns indicating directivity characteristics in Comparative Example 11. FIG. 23A is a graph showing a comparison between frequency characteristics in ±60-degree directions in Example 8. FIG. 23B is a graph showing a comparison between frequency characteristics in ±60-degree directions in Comparative Example 11.

In Example 8, a horn speaker was used that included speaker 4 shown in FIG. 6B, and a horn for speakers including a horn body having a different length from horn body 24 of horn for speakers 6 shown in FIG. 6B. As shown in FIG. 21, in the horn for speakers according to Example 8, a length from a first end portion to a second end portion of the horn body along the central axis direction was 15 mm (0.8 times as large as the radius of a first opening). Moreover, the inner surface of a sound path of the horn body flared out in the quartic curve from the first opening toward a second opening.

In Comparative Example 11, a horn speaker was used that included speaker 4 shown in FIG. 6B, and a horn for speakers including a horn body having a different length from horn body 24 of horn for speakers 6 shown in FIG. 6B, and a sound path having a different inner surface shape from sound path 38 of horn for speakers 6. As shown in FIG. 21, in the horn for speakers according to Comparative Example 11, a length from a first end portion to a second end portion of the horn body along the central axis direction was 15 mm. Moreover, the inner surface of the sound path of the horn body flared out in the quadratic curve from a first opening toward a second opening.

As shown in (h) and (i) in FIG. 22B, a few side lobes occurred with the frequency components of 8.0 to 9.0 kHz in Comparative Example 11. In contrast, as shown in (h) and (i) in FIG. 22A, in Example 8, the side lobes, which had occurred with the frequency components of 8.0 to 9.0 kHz, decreased, compared to Comparative Example 11. Moreover, as shown in FIG. 23A and FIG. 23B, in Example 8, lateral volume in the mid- to high-frequency ranges of 8.0 to 9.0 kHz and 12 kHz was kept down overall, compared to Comparative Example 11. Furthermore, as shown in FIG. 23A and FIG. 20A, in Example 8, the slopes of the lines in the mid- to high-frequency ranges of 5.0 to 10 kHz descended, and the directivity characteristics of the mid- to high-frequency ranges further increased, compared to Comparative Example 9. From this, it was found possible to increase the directivity characteristics of the mid- to high-frequency ranges by setting the length of the horn body to at least 15 mm (at least 0.8 times as large as the radius of the first opening) and forming the inner surface of the sound path of the horn body in the quartic curve.

Figure 24:
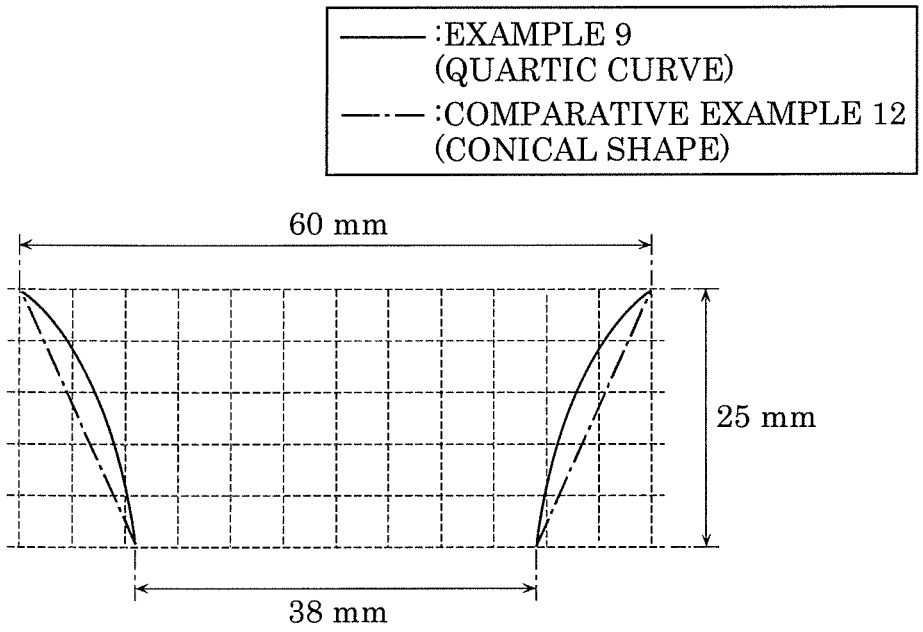
FIG. 24 is a diagram schematically illustrating the inner surface shapes of sound paths of horns for speakers according to Example 9 and Comparative Example 12.
Figure 25A:
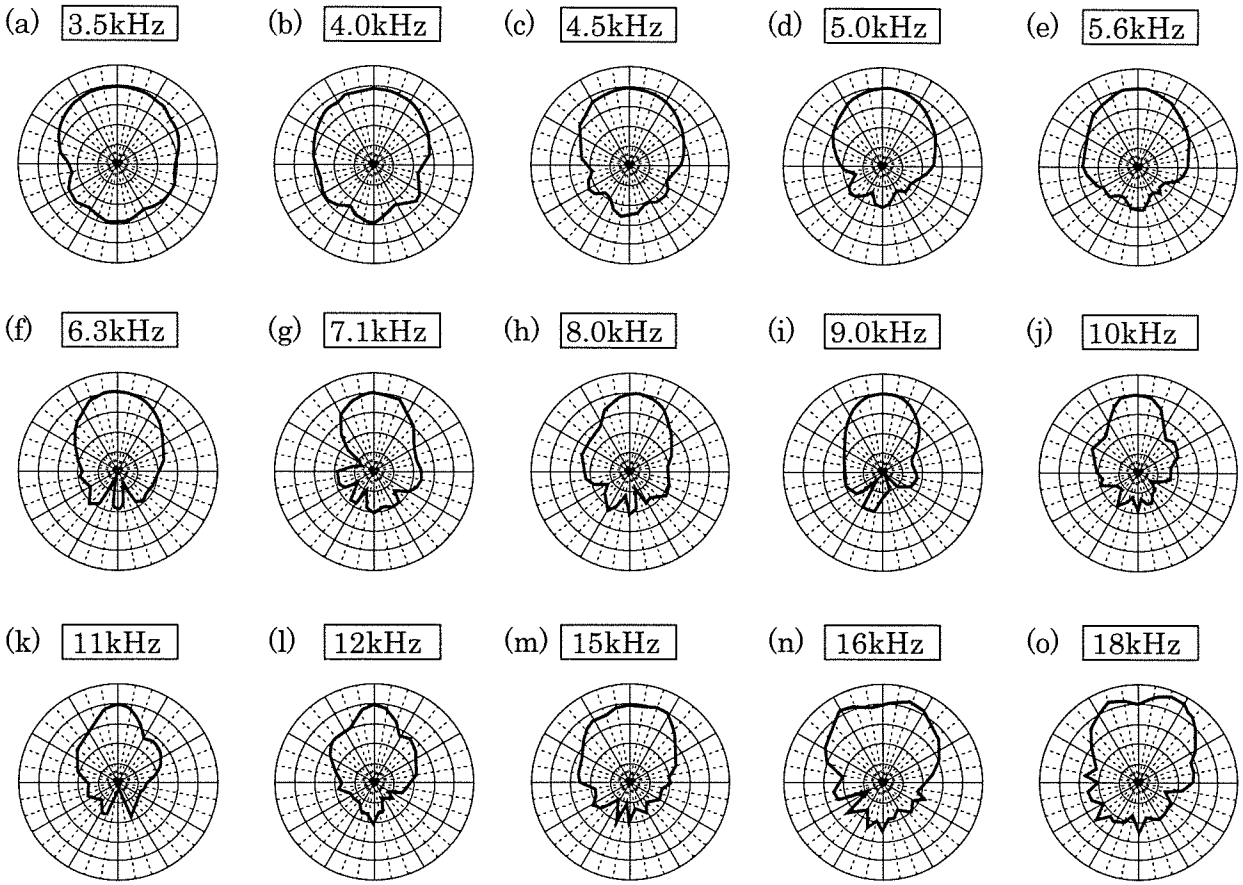
FIG. 25A shows polar patterns indicating directivity characteristics in Example 9.
Figure 25B:
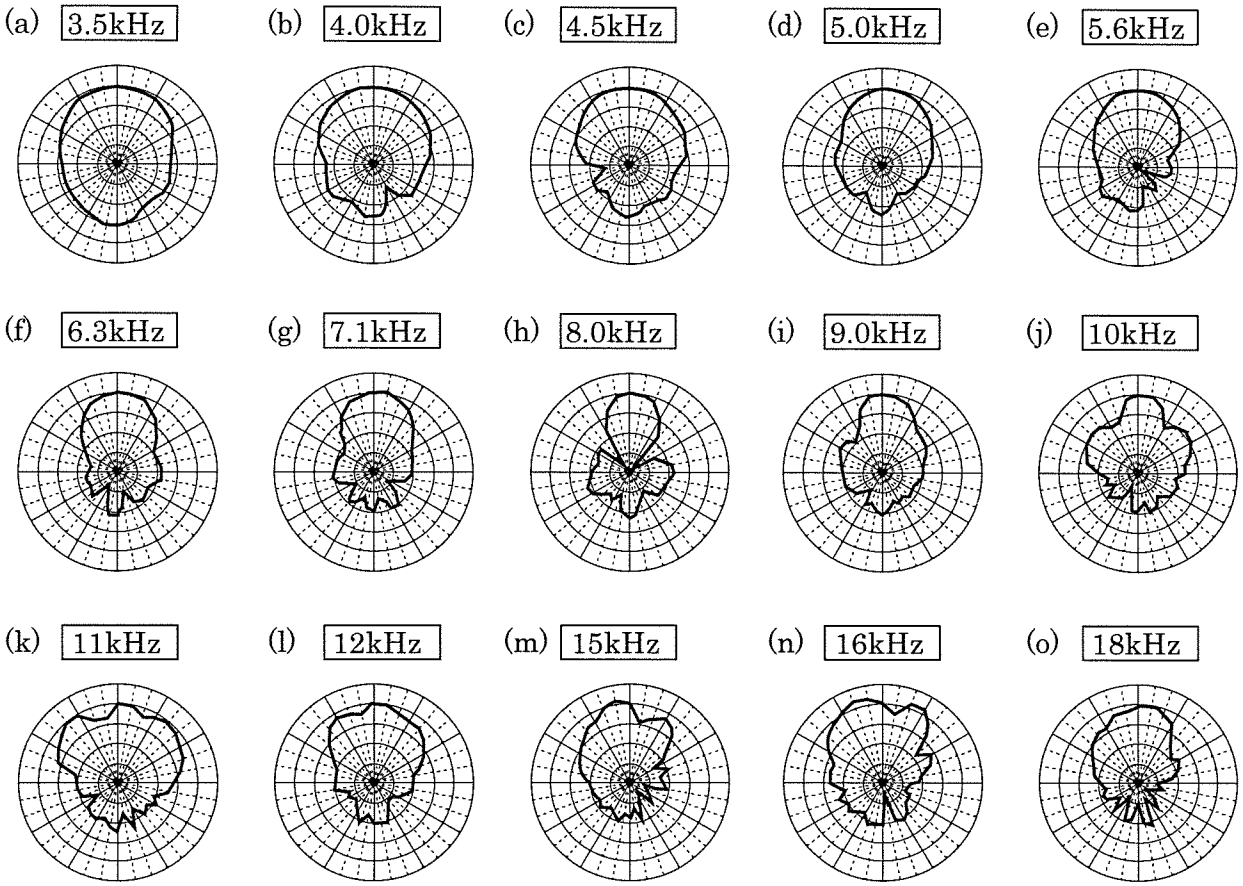
FIG. 25B shows polar patterns indicating directivity characteristics in Comparative Example 12.
Figure 26A:
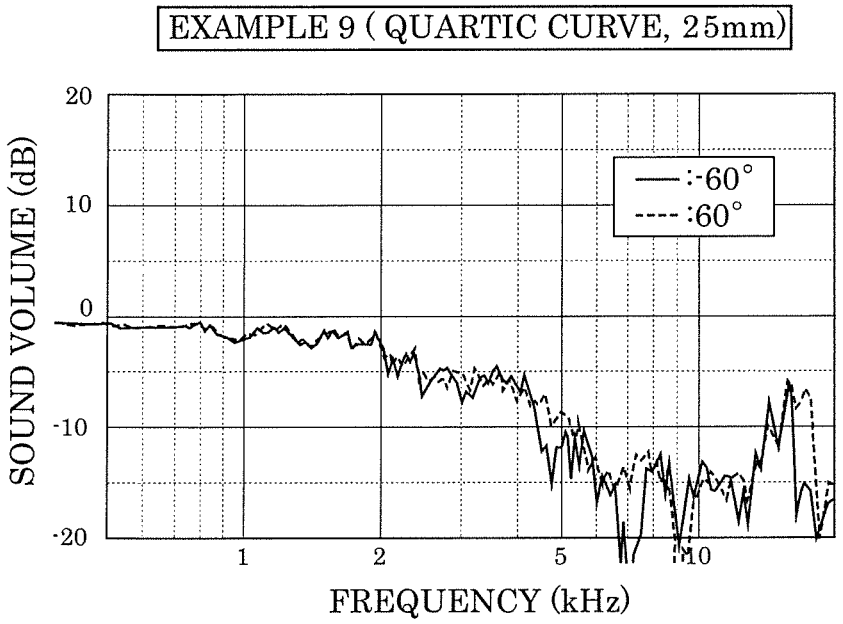
FIG. 26A is a graph showing a comparison between frequency characteristics in ±60-degree directions in Example 9.
Figure 26B:
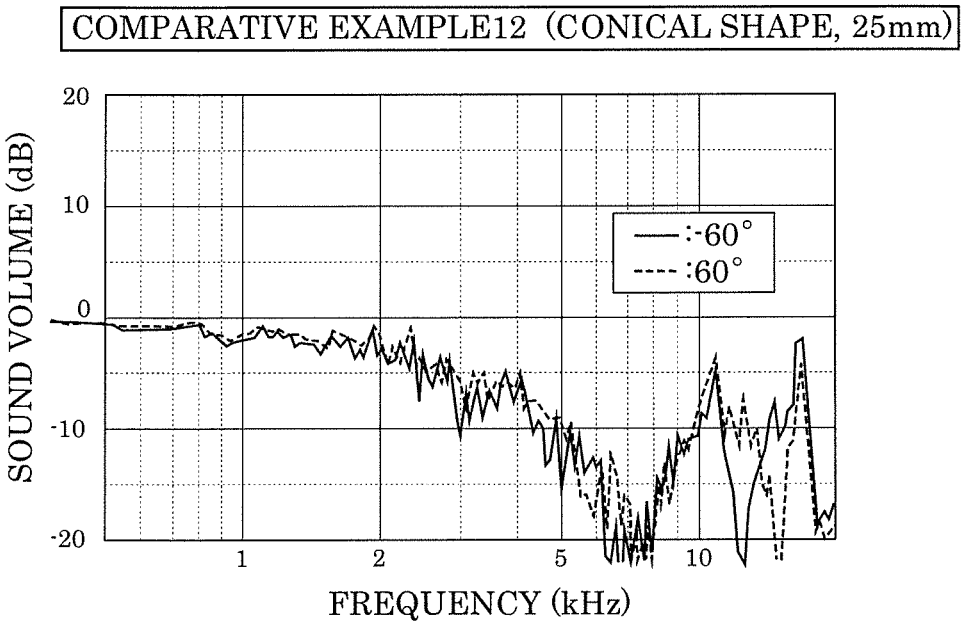
FIG. 26B is a graph showing a comparison between frequency characteristics in ±60-degree directions in Comparative Example 12.

Next, Example 9 and Comparative Example 12 will be described with reference to FIG. 24 through FIG. 26B. FIG. 24 is a diagram schematically illustrating the inner surface shapes of sound paths of horns for speakers according to Example 9 and Comparative Example 12. FIG. 25A shows polar patterns indicating directivity characteristics in Example 9. FIG. 25B shows polar patterns indicating directivity characteristics in Comparative Example 12. FIG. 26A is a graph showing a comparison between frequency characteristics in ±60-degree directions in Example 9. FIG. 26B is a graph showing a comparison between frequency characteristics in ±60-degree directions in Comparative Example 12.

In Example 9, a horn speaker was used that included speaker 4 shown in FIG. 6B, and a horn for speakers including the horn body having a different length from horn body 24 of horn for speakers 6 shown in FIG. 6B. As shown in FIG. 24, in the horn for speakers according to Example 9, a length from a first end portion to a second end portion of the horn body along the central axis direction was 25 mm (1.3 times as large as the radius of a first opening). Moreover, the inner surface of the sound path of the horn body flared out in the quartic curve from the first opening toward a second opening.

In Comparative Example 12, a horn speaker was used that included speaker 4 shown in FIG. 6B, and a horn for speakers including a horn body having a different length from horn body 24 of horn for speakers 6 shown in FIG. 6B, and a sound path having a different inner surface shape from sound path 38 of horn for speakers 6. As shown in FIG. 24, in the horn for speakers according to Comparative Example 12, a length from a first end portion to a second end portion of the horn body along the central axis direction was 25 mm. Moreover, the inner surface of the sound path of the horn body flared out in a straight line from a first opening toward a second opening, that is, had a conical shape.

As shown in (h) in FIG. 25B, in Comparative Example 12, relatively large side lobes occurred with the frequency component of 8.0 kHz. In contrast, as shown in (h) in FIG. 25A, in Example 9, the side lobes, which had occurred with the frequency component of 8.0 kHz, significantly decreased, compared to Comparative Example 12. Moreover, as shown in FIG. 26A and FIG. 26B, in Example 9, lateral volume in the mid- to high-frequency ranges of 9.0 to 12 kHz was kept down overall, compared to Comparative Example 12. Furthermore, as shown in FIG. 26A and FIG. 23A, in Example 9, the slopes of the lines in the mid- to high-frequency ranges of 5.0 to 10 kHz descended, and the directivity characteristics of the mid- to high-frequency ranges further increased, compared to Example 8. From the above, it was found possible to increase the directivity characteristics of the mid- to high-frequency ranges by setting the length of the horn body to 15 mm or better yet longer (at least 0.8 times as large as the radius of the first opening), and forming the inner surface of the sound path of the horn body in the quartic curve.

Variations

As described above, the technique disclosed in the present application has been exemplified by way of the embodiment. However, the technique disclosed in the present disclosure is not limited to this example, and can also be applied to embodiments in which modifications, replacements, additions, and omissions have been made. In addition, a new embodiment can be formed by combining the constituent elements described in the aforementioned embodiment.

In view of this, other embodiments are exemplified in the following.

Although image display apparatus 44 in which horn speaker 2 is installed is the television receiver in the aforementioned embodiment, the present disclosure is not limited to this. For example, image display apparatus 44 may be a display for personal computers.

Although second opening 34 of horn body 24 has the approximately square shape in the aforementioned embodiment, the present disclosure is not limited to this. For example, second opening 34 may have any shape other than a circular shape, such as an approximately quadrilateral shape or an elliptical shape.

Although each of four corners 36 of second opening 34 has the radiused shape in the aforementioned embodiment, the present disclosure is not limited to this. For example, each of four corners 36 may have a right-angled shape.

Although horn body 24 is formed into a straight type by making central axis 40 straight in the aforementioned embodiment, the present disclosure is not limited to this. For example, horn body 24 may be formed into a V-shaped bending type by making central axis 40 zigzag.

Hereinbefore, the technique disclosed in the present application has been exemplified by way of the foregoing embodiment. The enclosed drawings and details description have been provided for this reason.

Therefore, the constituent elements recited in the enclosed drawings and detailed description may include, aside from constituent elements essential to solving the aforementioned problem, constituent elements not essential to solving the aforementioned problem. As such, the recitation of these non-essential constituent elements in the enclosed drawings and detailed description should not be directly interpreted to mean the non-essential constituent elements are essential.

Furthermore, since the foregoing embodiment is for exemplifying the technique disclosed in the present disclosure, various modifications, replacements, additions, omissions, etc. can be carried out within the scope of the claims or equivalents thereof.

INDUSTRIAL APPLICABILITY

The present disclosure can be applied to, for example, a horn speaker installed in an image display apparatus etc.

REFERENCE MARKS IN THE DRAWINGS

2, 2A, 2B horn speaker
4, 4B speaker
6, 6A, 50, 64 horn for speakers
8 case
10, 10*b* diaphragm
12 driver
14 opening
15 edge
16 yoke
18 magnet
20 bobbin
22 voice coil
24, 24A, 51, 65 horn body
26, 52, 66 first end portion
28, 54, 68 first opening
30 step portion
32, 56, 70 second end portion
34, 34A, 58, 72 second opening
36, 36A, 60, 74 corner
38, 62, 76 sound path
40 central axis
42 straight portion
44 image display apparatus
46 rear cabinet

The invention claimed is:

1. A horn for speakers attachable to a speaker, the horn for speakers comprising:

a horn body including: a first opening located in a first end portion and having a circular shape; a second opening located in a second end portion and having a shape different from the circular shape; and a sound path connecting the first opening and the second opening, wherein in a cross section including a central axis of the horn body, an inner surface of the sound path flares out in a quartic curve from the first opening toward the second opening, a length from the first end portion to the second end portion of the horn body is at least 0.8 times as large as a radius of the first opening, and in a cross section orthogonal to the central axis of the horn body, a relational expression $S=S_0\times(1+a\times z^4)$ is satisfied, where $S_0$ is an area of the first opening, S is an area of the sound path at position z away from the first opening along the central axis, and a is a constant.

2. The horn for speakers according to claim 1, wherein the second opening has an approximately quadrilateral shape, and each of four corners of the second opening has a radiused shape.

3. The horn for speakers according to claim 2, wherein a radius of curvature of each of the four corners is 0.8 times as large as the radius of the first opening.

4. A horn speaker, comprising:

a speaker including a diaphragm having a circular shape in a plan view; and the horn for speakers according to claim 1 attached to the speaker, wherein the diaphragm is disposed in the first opening of the horn for speakers.

* * * * *